US009914008B2

(12) United States Patent
Shavell et al.

(10) Patent No.: US 9,914,008 B2
(45) Date of Patent: Mar. 13, 2018

(54) LOCKING ROTATIONAL SUSPENSION TRAINING SYSTEM

(71) Applicant: Academus Solutions, LLC, Ijamsville, MD (US)

(72) Inventors: David L. Shavell, Ijamsville, MD (US); Elvin M. Peprah, Pittsburgh, PA (US); David W. Tarr, Silver Spring, MD (US)

(73) Assignee: Academus Solutions, LLC, Ijamsville, MD (US)

( * ) Notice: Subject to any disclaimer, the term of this patent is extended or adjusted under 35 U.S.C. 154(b) by 0 days.

(21) Appl. No.: 15/366,465

(22) Filed: Dec. 1, 2016

(65) Prior Publication Data

US 2017/0157448 A1 Jun. 8, 2017

Related U.S. Application Data

(60) Provisional application No. 62/262,567, filed on Dec. 3, 2015.

(51) Int. Cl.

| | |
|---|---|
| ***B60P 7/00*** | (2006.01) |
| ***A63B 21/08*** | (2006.01) |
| ***A63B 21/068*** | (2006.01) |
| ***A63B 23/12*** | (2006.01) |

(52) U.S. Cl.

CPC ..... *A63B 21/08* (2013.01); *A63B 21/068* (2013.01); *A63B 23/1236* (2013.01)

(58) Field of Classification Search

None

See application file for complete search history.

(56) References Cited

U.S. PATENT DOCUMENTS 5,205,020 A * 4/1993 Kamper ..... B60P 7/083 24/68 CD 5,295,420 A * 3/1994 Grimes ..... B67B 7/186 81/3.43

(Continued)

FOREIGN PATENT DOCUMENTS

WO 2017/096204 A1 6/2017

OTHER PUBLICATIONS

International Search Report and Written Opinion received for PCT Patent Application. PCT/US20161064685, dated Feb. 21, 2017, 9 pages.

*Primary Examiner* — Stephen R Crow

(74) *Attorney, Agent, or Firm* — Fiala & Weaver P.L.L.C.

(57) ABSTRACT

A locking rotational suspension training system is described that includes a locking rotational device within which a user can secure a strap to anchor the strap when the device is in a locked mode, and to enable the strap to move freely through the device when the device is in an unlocked mode. The locking rotational device includes a wheel and brakes that clamp around the wheel to prevent wheel rotation and secure a strap there between in a locked mode and that are positioned away from the wheel to allow wheel rotation and permit the strap to move freely in an unlocked mode. Such a locking rotational device enables a user to lock a strap at any point along its length thereby allowing the user to engage in a full range of bodyweight rotational, static, symmetric and asymmetric exercises, as well as weighted "pulley type" exercises.

20 Claims, 13 Drawing Sheets

(56) References Cited

U.S. PATENT DOCUMENTS

| | | | | |
|---|---|---|---|---|
| 6,641,116 | B1 * | 11/2003 | Huang | B60P 7/083 24/68 CD |
| 6,647,835 | B1 | 11/2003 | Tseng | |
| 6,935,031 | B1 | 8/2005 | Huang | |
| 8,209,821 | B1 * | 7/2012 | Chen | B60P 7/083 24/265 CD |
| 8,496,298 | B2 | 7/2013 | Martini et al. | |
| 8,763,870 | B2 | 7/2014 | Davis | |
| 9,162,605 | B2 * | 10/2015 | Durand | B60P 7/083 |
| 9,233,637 | B1 * | 1/2016 | Huang | B60P 7/083 |
| 9,469,239 | B2 * | 10/2016 | Armour | B60P 7/083 |
| 9,656,591 | B1 * | 5/2017 | Dumenigo | B60P 7/083 |
| 2001/0054451 | A1 | 12/2001 | Angarola et al. | |
| 2008/0060203 | A1 | 3/2008 | Metcalf | |
| 2011/0088226 | A1 | 4/2011 | Degen | |
| 2013/0025098 | A1 | 1/2013 | Smith | |
| 2014/0054912 | A1 | 2/2014 | Bustos | |

* cited by examiner

LOCKING ROTATIONAL SUSPENSION TRAINING SYSTEM

CROSS-REFERENCE TO RELATED APPLICATIONS

This application claims the benefit of U.S. Provisional Patent Application No. 62/262,567, filed on Dec. 3, 2015 and entitled "Locking Rotational Suspension Trainer", the entirety of which is incorporated by reference herein.

BACKGROUND OF THE INVENTION

Field of the Invention

The present invention relates to exercise equipment. More particularly, the present invention relates to a locking rotational suspension training system used as exercise equipment.

Background Art

Some conventional resistance training systems rely on a user's bodyweight to supply the main force of resistance via the user suspending from a strap, cable or cord. Conventional suspension training systems that allow a user to perform exercises using a strap, cable or cord do not enable the strap, cable or cord to be anchored in a fixed position, or if the strap, cable or cord can be anchored, it can only be fixed at a single point via, for example, features associated with the strap itself (such as the introduction of a loop on the strap through which a pin is inserted), or they do not allow for the length of the strap, cable or cord to be adjusted. For example, when a strap in these systems is anchored, the strap is then fixed in position and the length(s) of the free end(s) of the strap cannot be changed. These restrictions prevent the user from performing the full breadth of exercises possible, including exercises that employ a user's body weight and those that employ a suspended weight, or both, under the widest possible conditions while using the broadest range of anchor points possible.

BRIEF SUMMARY OF THE INVENTION

Locking rotational suspension training systems and devices are described herein that allow a user to secure a strap within a lockable device to anchor the strap when the device is in a locked mode, and to enable the strap to move freely through the device when the device is in an unlocked mode. The system includes a locking rotational device. The locking rotational device includes a wheel and brakes that clamp around the wheel to prevent wheel rotation and to secure a strap there between in a locked mode and that may be positioned away from the wheel to allow wheel rotation and to permit the strap to move freely with the wheel in an unlocked mode. Such a locking rotational device enables a user to lock a strap at any point along its length thereby allowing the user to engage in a full range of bodyweight rotational, static, symmetric and asymmetric exercises, as well as weighted "pulley type" exercises.

In another aspect, a locking rotational suspension training system may comprise a device that includes a wheel and a wheel bracket that includes a wheel bracket base, a first wheel bracket arm that extends from a first side of the wheel bracket base, and a second wheel bracket arm that extends from a second side of the wheel bracket base and is substantially parallel to the first wheel bracket arm, the wheel being disposed between the first wheel bracket arm and the second wheel bracket arm. A first locking pin may be connected to and disposed between a first side of a first end of the first wheel bracket arm and a first side of a first end of the second wheel bracket arm. A second locking pin may be connected to and disposed between a second side of the first end of the first wheel bracket arm and a second side of the first end of the second wheel bracket arm. The device may further include a first grip that is attached to the first end of the first wheel bracket arm and a second grip that is attached to the first end of the second wheel bracket arm. The device may further include a first jaw component including a first jaw plate, a second jaw plate that is substantially parallel to the first jaw plate, and a first wheel brake that is connected to and disposed between the first jaw plate and the second jaw plate. A first end of the first jaw plate may include a first connector and a first end of the second jaw plate may include a second connector, the first and second connectors being configured to engage with the first locking pin to place the first jaw component in a locked position and to disengage from the first locking pin to place the first jaw component in an unlocked position. The device may further include a second jaw component having a third jaw plate, a fourth jaw plate that is substantially parallel to the third jaw plate, and a second wheel brake that is connected to and disposed between the third jaw plate and the fourth jaw plate. A first end of the third jaw plate may include a third connector and a first end of the fourth jaw plate may include a fourth connector, the third and fourth connectors being configured to engage with the second locking pin to place the second jaw component in a locked position and to disengage from the second locking pin to place the second jaw component in an unlocked position. In some aspects, the device includes a jaw bracket having a jaw bracket base, a first jaw bracket arm that extends from a first side of the jaw bracket base, and a second jaw bracket arm that extends from a second side of the jaw bracket base and is substantially parallel to the first jaw bracket arm, a second end of the first jaw plate and a second end of the third jaw plate being disposed between the first wheel bracket arm and the first jaw bracket arm, and a second end of the second jaw plate and a second end of the fourth jaw plate being disposed between the second wheel bracket arm and the second jaw bracket arm. The device may further include a master bracket having a master bracket base, a first master bracket arm that extends from a first side of the master bracket base, and a second master bracket arm that extends from a second side of the master bracket base, the jaw bracket being disposed between the first master bracket arm and the second master bracket arm. A jaw axel may extend through a corresponding jaw axel channel in each of the first master bracket arm, the first jaw bracket arm, the second end of the first jaw plate, the second end of the third jaw plate, the first wheel bracket arm, the second wheel bracket arm, the second end of the fourth jaw plate, the second end of the second jaw plate, the second jaw bracket arm, and the master bracket arm, and a wheel axel may extend through a corresponding wheel axel channel in each of the first master bracket arm, the first jaw bracket arm, the first wheel bracket arm, the wheel, the second wheel bracket arm, the second jaw bracket arm, and the second master bracket arm. A bracket guide may extend through a corresponding bracket guide channel in each of the master bracket base, the jaw bracket base, and the wheel bracket base. A first spring may surround the bracket guide between the master bracket and the jaw bracket, and a second spring may surround the bracket guide between the wheel bracket and a first end of the bracket guide. In some aspects, the first and second grips are configured to transition the device from a locked mode to an unlocked mode by pulling on the first and second grips in a direction substantially parallel to the bracket guide, the wheel axel channel in the jaw bracket having a length in the direction parallel to the bracket guide larger than a diameter of the wheel axel allowing the wheel axel to slide therein in the direction substantially parallel to the bracket guide, and the jaw axel channel in the master bracket having a length in the direction substantially parallel to the bracket guide larger than a diameter of the jaw axel allowing the jaw axel to slide therein in the direction substantially parallel to the bracket guide. The system may further include a first strap arranged to extend around a portion of the wheel and between the first locking pin and the second locking pin, the first strap extending between the wheel and the first wheel brake and between the wheel and the second wheel brake, the first and second wheel brakes clamping down and holding the strap statically against the wheel preventing wheel rotation in the locked mode, and the first and second wheel brakes being positioned away from the wheel permitting the strap to move freely around the wheel and the wheel to rotate in the unlocked mode.

In another aspect, a locking rotational suspension training system may comprise a device that includes a wheel and a wheel bracket having a wheel bracket base, a first wheel bracket arm that extends from a first side of the wheel bracket base, and a second wheel bracket arm that extends from a second side of the wheel bracket base and is substantially parallel to the first wheel bracket arm, the wheel being disposed between the first wheel bracket arm and the second wheel bracket arm. A first locking component may be connected to and disposed between a first side of a first end of the first wheel bracket arm and a first side of a first end of the second wheel bracket arm. A second locking component may be connected to and disposed between a second side of the first end of the first wheel bracket arm and a second side of the first end of the second wheel bracket arm. The device may further include a first grip that is attached to the first end of the first wheel bracket arm and a second grip that is attached to the first end of the second wheel bracket arm. The device may further include a first jaw component having a first end including a first connector and a second end having a jaw axel channel therein, the first connector being configured to engage with the first locking component to place the first jaw component in a locked position and to disengage from the first locking component to place the first jaw component in an unlocked position, and a second jaw component having a first end including a second connector and a second end having a jaw axel channel therein, the second connector being configured to engage with the second locking component to place the second jaw component in a locked position and to disengage from the second locking component to place the second jaw component in an unlocked position. A first wheel brake may be connected to the first jaw component and a second wheel brake may be connected to the second jaw component. The device may further include a jaw bracket having a jaw bracket base, a first jaw bracket arm that extends from a first side of the jaw bracket base, and a second jaw bracket arm that extends from a second side of the jaw bracket base and is substantially parallel to the first jaw bracket arm, a first side of the first end of the first jaw component and a first side of the first end of the second jaw component being disposed between the first wheel bracket arm and the first jaw bracket arm, and a second side of the first end of the first jaw component and a second side of the first end of the second jaw component being disposed between the second wheel bracket arm and the second jaw bracket arm. The device may further include a master bracket having a master bracket base, a first master bracket arm that extends from a first side of the master bracket base, and a second master bracket arm that extends from a second side of the master bracket base and is substantially parallel to the first master bracket arm, the jaw bracket being disposed between the first master bracket arm and the second master bracket arm. The device may further include a jaw axel that extends through a corresponding jaw axel channel in each of the first master bracket arm, the first jaw bracket arm, the first side of the first end of the first jaw component, the first side of the first end of the second jaw component, the first wheel bracket arm, the second wheel bracket arm, the second side of the first end of the second jaw component, the second side of the first end of the first jaw component, the second jaw bracket arm, and the master bracket arm, and a wheel axel that extends through a corresponding wheel axel channel in each of the first master bracket arm, the first jaw bracket arm, the first wheel bracket arm, the wheel, the second wheel bracket arm, the second jaw bracket arm, and the second master bracket arm. A bracket guide may extend through a corresponding bracket guide channel in each of the master bracket base, the jaw bracket base, and the wheel bracket base. A first spring may surround the bracket guide between the master bracket and the jaw bracket, and a second spring may surround the bracket guide between the wheel bracket and a first end of the bracket guide. In some aspects, the first and second grips are configured to transition the device from a locked mode to an unlocked mode by pulling on the first and second grips in a direction substantially parallel to the bracket guide, the wheel axel channel in the jaw bracket having a length in the direction substantially parallel to the bracket guide larger than a diameter of the wheel axel allowing the wheel axel to slide therein in the direction substantially parallel to the bracket guide, and the jaw axel channel in the master bracket having a length in the direction substantially parallel to the bracket guide larger than a diameter of the jaw axel allowing the jaw axel to slide therein in the direction substantially parallel to the bracket guide. The system may further include a first strap arranged to extend around a portion of the wheel and between the first locking pin and the second locking pin, the first strap extending between the wheel and the first wheel brake and between the wheel and the second wheel brake, the first and second wheel brakes clamping down and holding the strap statically against the wheel preventing wheel rotation in the locked mode, and the first and second wheel brakes being positioned away from the wheel permitting the strap to move freely around the wheel and the wheel to rotate in the unlocked mode.

These and other objects, advantages and features will become readily apparent in view of the following detailed description of the invention. Note that the Summary and Abstract sections may set forth one or more, but not all exemplary embodiments of the present invention as contemplated by the inventor(s).

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1:
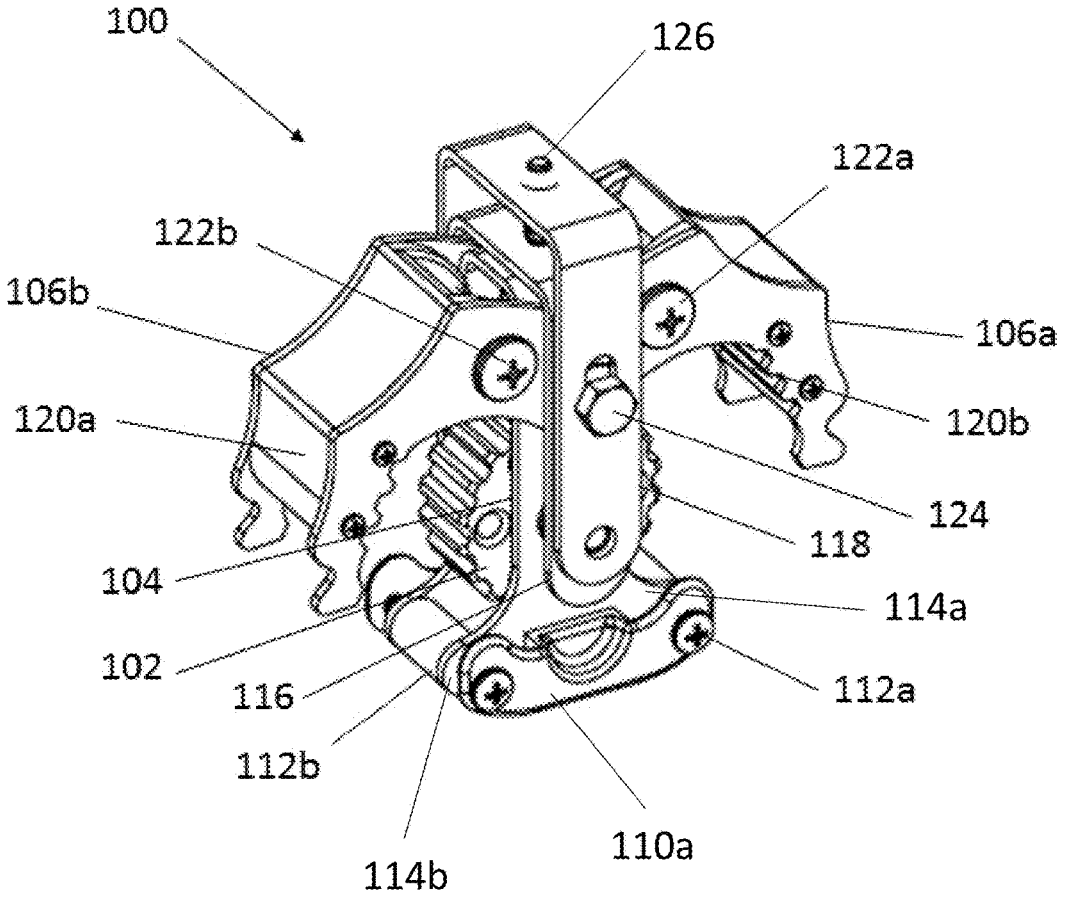
FIG. 1 shows a front isometric view of a locking rotational device in an unlocked mode in accordance with an embodiment.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

The present specification discloses one or more embodiments that incorporate the features of the invention. The disclosed embodiment(s) merely exemplify the invention. The scope of the invention is not limited to the disclosed embodiment(s). The invention is defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

In the discussion, unless otherwise stated, adjectives such as "substantially," "approximately," and "about" modifying a condition or relationship characteristic of a feature or features of an embodiment of the disclosure are understood to mean that the condition or characteristic is defined to be within tolerances that are acceptable for operation of the embodiment for an application for which it is intended.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Still further, it should be noted that the drawings/figures are not drawn to scale unless otherwise noted herein.

Numerous exemplary embodiments are now described. Any section/subsection headings provided herein are not intended to be limiting. Embodiments are described throughout this document, and any type of embodiment may be included under any section/subsection. Furthermore, it is contemplated that the disclosed embodiments may be combined with each other in any manner. That is, the embodiments described herein are not mutually exclusive of each other and may be practiced and/or implemented alone, or in any combination.

Example Embodiments

The example embodiments described herein are provided for illustrative purposes only, and are not limiting. The examples described herein may be adapted to any type of locking rotational suspension training system or locking rotational device. Further structural and operational embodiments, including modifications/alterations, will become apparent to persons skilled in the relevant art(s) from the teachings herein.

A locking rotational suspension training system according to various embodiments will now be described. First, components and configuration of an example locking rotational suspension training system and a locking rotational device are described. Next, exemplary materials of components of the locking rotational suspension training system and the locking rotational device are described. Thereafter, operation of the locking rotational device is described including a description of the locking rotational device in a locked mode, in an unlocked mode, and while transitioning between a locked mode and an unlocked mode. Finally, various applications of the locking rotational suspension training system are described.

A. Components and Configuration of an Example Locking Rotational Suspension Training System FIG. 1 shows a front isometric view of a locking rotational device 100 in a locked mode, according to an embodiment. Locking rotational device 100 may comprise a part of a locking rotational suspension training system. As shown in FIG. 1, locking rotational device 100 includes a wheel 102, a wheel bracket 104, a first jaw component 106*a*, a second jaw component 106*b*, a first grip 110*a*, a first locking pin 112*a*, a second locking pin 112*b*, a jaw bracket 116, a master bracket 118, a first suspension pin 122*a*, a second suspension pin 122*b*, a jaw axel 124, and a bracket guide channel 126. First jaw component 106*a* includes a first wheel brake 120*a* and second jaw component 106*b* includes a second wheel brake 120*b*.

Figure 5:
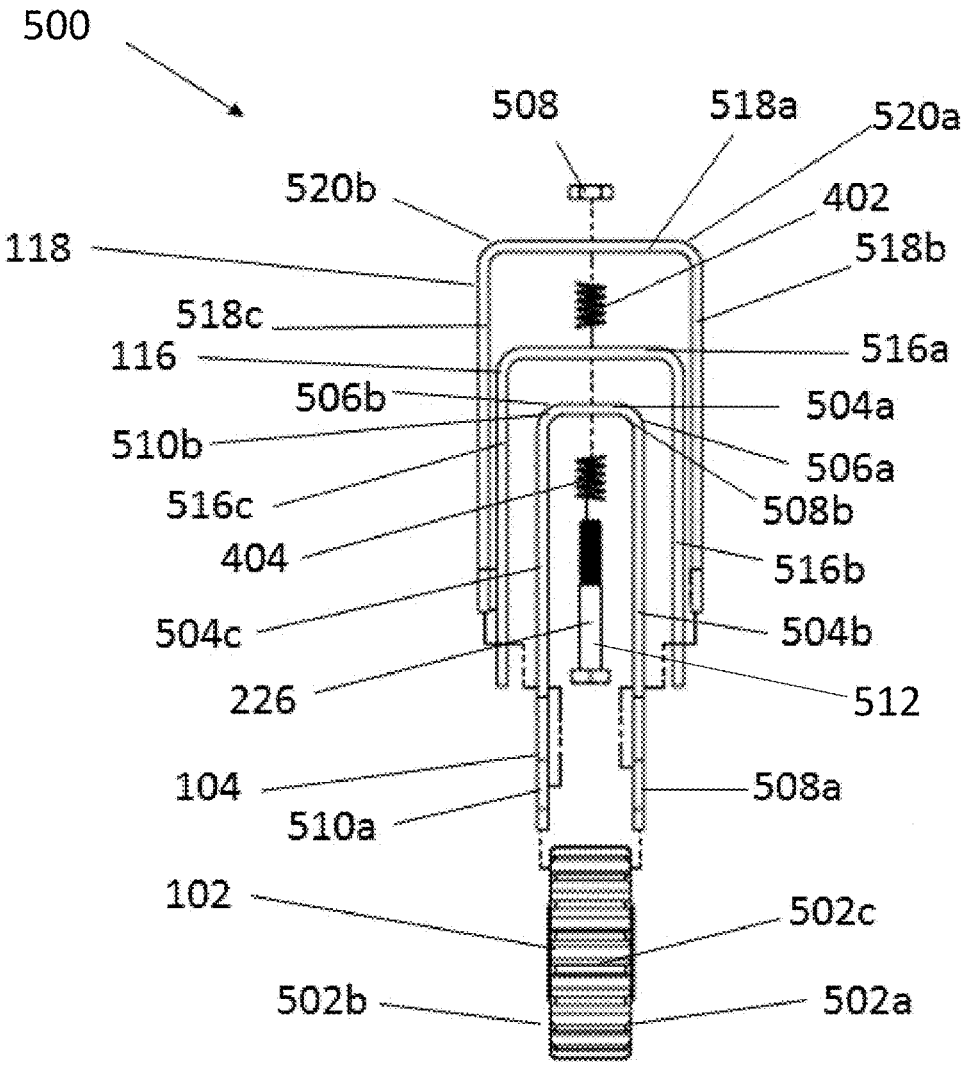
FIG. 5 shows an exploded side view of a portion of the locking rotational device of FIG. 1.

FIG. 5 shows an exploded side view of a portion of locking rotational device 100. As shown in FIG. 5, wheel 102 includes a first wheel side 502*a*, a second wheel side 502*b* opposite first wheel side 502*a*, and a wheel edge 502*c*.

As also shown in FIG. 5, wheel bracket 104 comprises a wheel bracket base 504*a*, a first wheel bracket arm 504*b* that extends from a first side 506*a* of wheel bracket base 504*a*, and a second wheel bracket arm 504*c* that extends from a second side 506*b* of wheel bracket base 504*a* and is substantially parallel to first wheel bracket arm 504*b*. First wheel bracket arm 504*b* comprises a first end 508*a* and a second end 508*b*, first end 508*a* being opposite second end 508*b* of first wheel bracket arm 504*b* that is attached to wheel bracket base 504*a*. Second wheel bracket arm 504*c* comprises a first end 510*a* and a second end 510*b*, first end 510*a* being opposite second end 510*b* of second wheel bracket arm 504*c* that is attached to wheel bracket base 504*a*.

Wheel bracket 104 also optionally includes a first fin 114*a* and a second fin 114*b* that fan out in opposite directions on either side of first end 508*a* of first wheel bracket arm 504*b*. Similar third and fourth fins (not shown) may optionally fan out in opposite directions on either side of first end 510*a* of second wheel bracket arm 504*c*. First fin 114*a*, second fin 114*b*, third fin (not shown) and fourth fin (not shown) extend in a direction substantially parallel to first wheel side 502*a* and second wheel side 502*b*.

As further shown in FIG. 1, first grip 110*a* is connected to first and second fins 114*a* and 114*b* of first wheel bracket arm 504*b* and second grip 110*b* is connected to third and fourth fins (not shown) of second wheel bracket arm. First grip 110*a* and second grip 110*b* may be used to transition locking rotational device 100 from a locked mode to an unlocked mode as described more fully in section C2.

In the present embodiment, each of first grip 110*a* and second grip 110*b* are connected to the corresponding fins using two screws. However, persons skilled in the relevant art will readily appreciate that any number of connecting mechanisms may be used to join the grips to the fins including but not limited to adhesive attachment, soldering, or a combination thereof. Furthermore, first grip 110*a* and second grip 110*b* may be an integrated part of first wheel bracket arm 504*b* and first wheel bracket arm 504*c*, respectively.

In an alternate embodiment in which first fin 114*a*, second fin 114*b*, third fin (not shown) and fourth fin (not shown) are not included, first grip 110*a* may be attached to some other portion of first wheel bracket arm 504*b*, and second grip 110*b* may be attached to some other portion of second wheel bracket arm 504*c*, regardless of the shape of the wheel bracket arms of wheel bracket 104.

First locking pin 112*a* and second locking pin 112*b* are configured to allow first jaw component 106*a* and second jaw component 106*b*, respectively, to attach thereto to place first jaw component 106*a* and second jaw component 106*b* in a locked position, as described more fully in section C1. First locking pin 112*a* is connected to and disposed between first fin 114*a* and third fin (not shown) and second locking pin 112*b* is connected to and disposed between second fin 114*b* and fourth fin (not shown). First locking pin 112*a* may extend through a corresponding first locking pin channel in each of first grip 110*a*, first fin 114*a*, third fin (not shown) and second grip 110*b*. Similarly, second locking pin 112*b* may extend through a corresponding second locking pin channel in each of first grip 110*a*, second fin 114*b*, fourth fin (not shown) and second grip 110*b*. In the absence of first fin 114*a*, second fin 114*b*, third fin (not shown) and fourth fin (not shown), first locking pin 112*a* and second locking pin 112*b* may be connected to and disposed between some other portion of first wheel bracket 504*b* arm and second wheel bracket arm 504*c* of wheel bracket 104.

Figure 3:
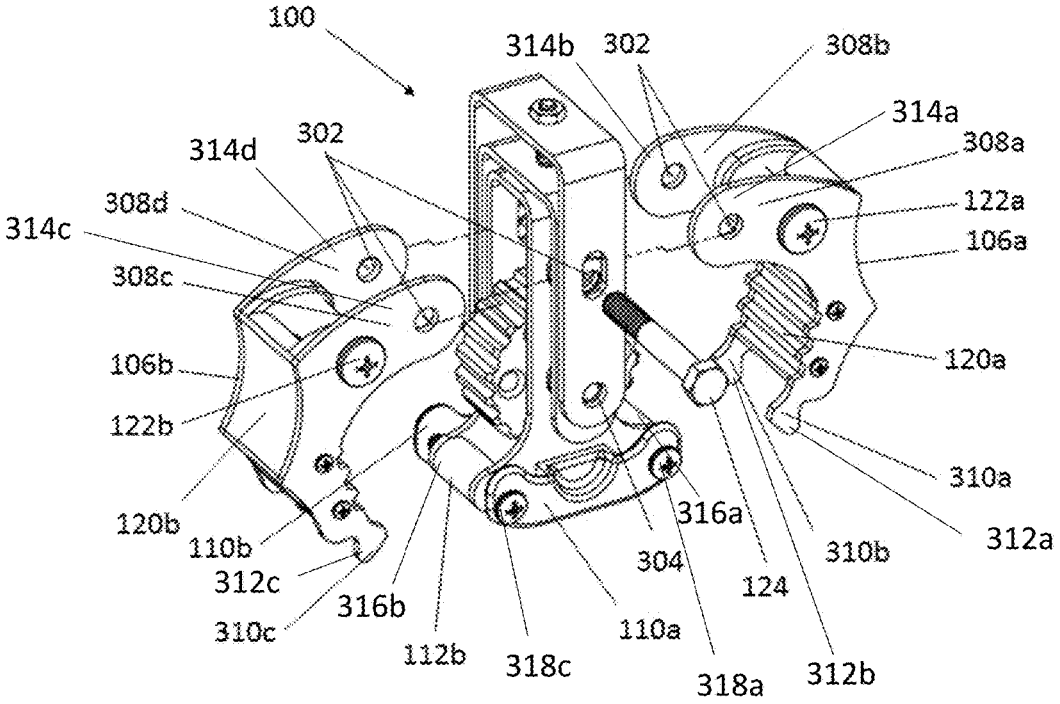
FIG. 3 shows an exploded front isometric view of the locking rotational device of FIG. 1.

With respect to FIG. 3, it should be noted that first locking pin 112*a* and second locking pin 112*b* may each comprise a cylindrical portion or tube 316*a*, and 316*b*, respectively, and two screws at either end of first cylindrical portion 316*a* and second cylindrical portion 316*b*, respectively, such as screws 318*a* and 318*c* shown in FIG. 3. Insertion of the two screws through the locking pin channels into either end of the cylindrical portion causes the cylindrical portion to be held in place between the fins. Of course, first locking pin 112*a* and second locking pin 122*b* are not limited to being cylinders and screws and other types of connections may be used to connect first and second locking pins 112*a* and 112*b*, respectively, between first and second wheel bracket arms 504*a* and 504*b*.

In FIG. 1, locking rotational device 100 is in an unlocked mode. That is, in FIG. 1, first jaw component 106*a* and second jaw component 106*b* are positioned away from wheel 102 such that wheel 102 can rotate freely about a wheel axel 406, which is visible in FIGS. 4 and 6.

Figure 2:
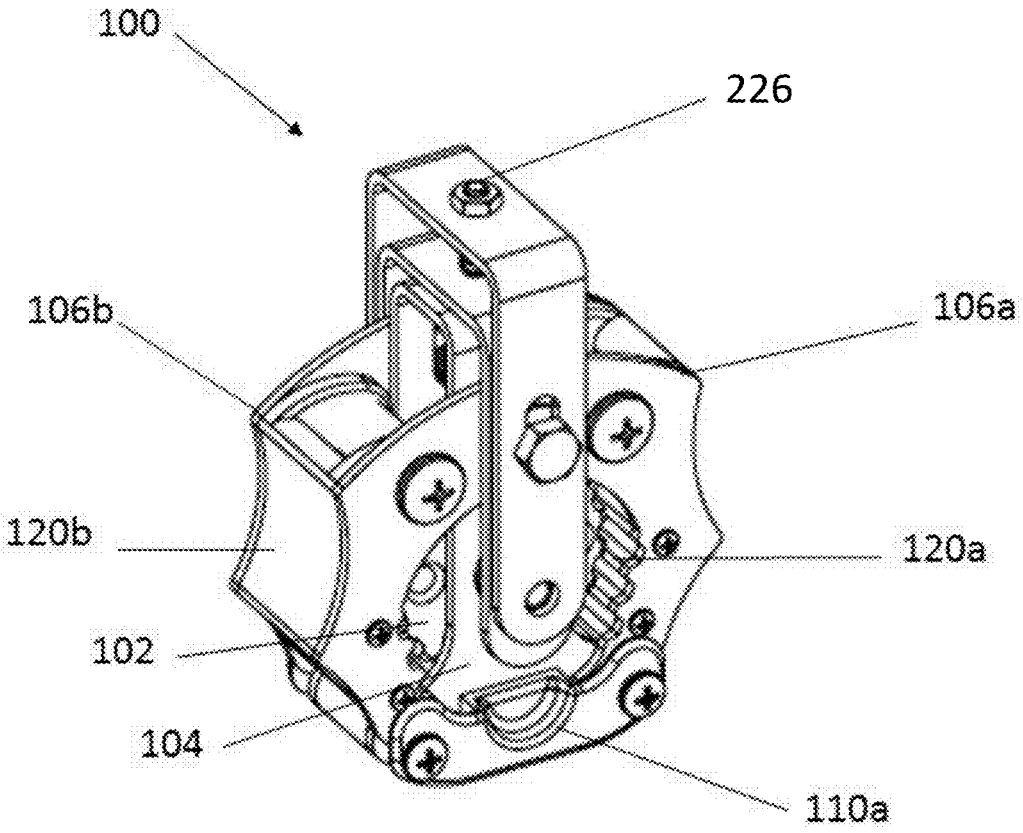
FIG. 2 shows a front isometric view of the locking rotational device of FIG. 1 in a locked mode.

FIG. 2 shows a front isometric view of locking rotational device 100. As shown in FIG. 2, locking rotational device 100 also includes a bracket guide 226. Bracket guide 226 comprises a connector such as a pin or screw (although other types of connectors may be used) that connects together wheel bracket 104, jaw bracket 116, and master bracket 118. Bracket guide 226 extends through master bracket 118, jaw bracket 116, and wheel bracket 104 as more clearly shown in FIG. 4.

In FIG. 2, locking rotational device 100 is in a locked mode. That is, in FIG. 2, first jaw component 106*a* and second jaw component 106*b* are closed around wheel 102 such that first wheel brake 120*a* and second wheel brake 120*b* clamp down around wheel 102 fixing wheel 102 securely there between and preventing wheel rotation. In the locked mode, first jaw component 106*a* is connected to first locking pin 112*a* and second jaw component 106*b* is connected to second locking pin 112*b*.

FIG. 3 shows an exploded front isometric view of locking rotational device 100. As shown in FIG. 3, first jaw component 106*a* comprises a first jaw plate 308*a* that includes a first connector 310*a* at a first end 312*a* thereof, a second jaw plate 308*b* that includes a second connector 310*b* at a first end 312*b* thereof, and first suspension pin 122*a*. As also shown in FIG. 3, second jaw component 106*b* comprises a third jaw plate 308*c* that includes a third connector 310*c* at a first end 312*c* thereof, a fourth jaw plate 308*d* that includes a fourth connector (not shown) at a first end (not shown) thereof, and a second suspension pin 122*b*. Jaw axel 124 extends through a corresponding jaw axel channel 302 in a second end 314*a* of first jaw plate 308*a*, a second end 314*b* of second jaw plate 308*b*, a second end 314*c* of third jaw plate 308*c*, and a second end 314*d* of fourth jaw plate 308*d*. Jaw axel 124 also extends through a corresponding jaw axel channel 302 in each of master bracket 118, jaw bracket 116 and wheel bracket 104 as described more fully with respect to FIG. 5. First wheel brake 120*a* is connected to and disposed between first jaw plate 308*a* and second jaw plate 308*b*. Second wheel brake 120*b* is connected to and disposed between third jaw plate 308*c* and fourth jaw plate 308*d*. First suspension pin 122*a* extends through and between first jaw plate 308*a* and second jaw plate 308*b*. Second suspension pin 122*b* extends through and between third jaw plate 308*c* and fourth jaw plate 308*d*. First suspension pin 122*a* and second suspension pin 122*b* may be comprised of a cylindrical portion having a bar or screws extending there through. Alternately, first suspension pin 122*a* and second suspension pin 122*b* may be comprised of two screws. These examples are not limiting, however, and persons of ordinary skill in the relevant art(s) will understand that suspension pins 112*a* and 122*b* may be implemented in other ways.

As shown in FIG. 3, first connector 310*a*, second connector 310*b*, third connector 310*c* and fourth connector (not shown) each comprise hooks. However, persons skilled in the relevant art(s) will understand that such connectors are not limited to hooks and that other types of connectors may be used. Furthermore, although first jaw component 106*a* is illustrated as being formed from first jaw plate 308*a* and second jaw plate 308*b*, and second jaw component 106*b* is illustrated as being formed from third jaw plate 308*c* and fourth jaw plate 308*d*, in an alternate embodiment, each of first and second jaw components 106*a* and 106*b* may be formed as a single integrated component, each having a wheel brake formed thereon. In still further accordance with this alternate embodiment, an entire width of respective first ends of first and second jaw components 106*a* and 106*b* may comprise a connector of a type suitable to connect respective first ends of first and second jaw components 106*a* and 106*b* to first and second locking pins 112*a* and 112*b*, respectively.

Figure 4:
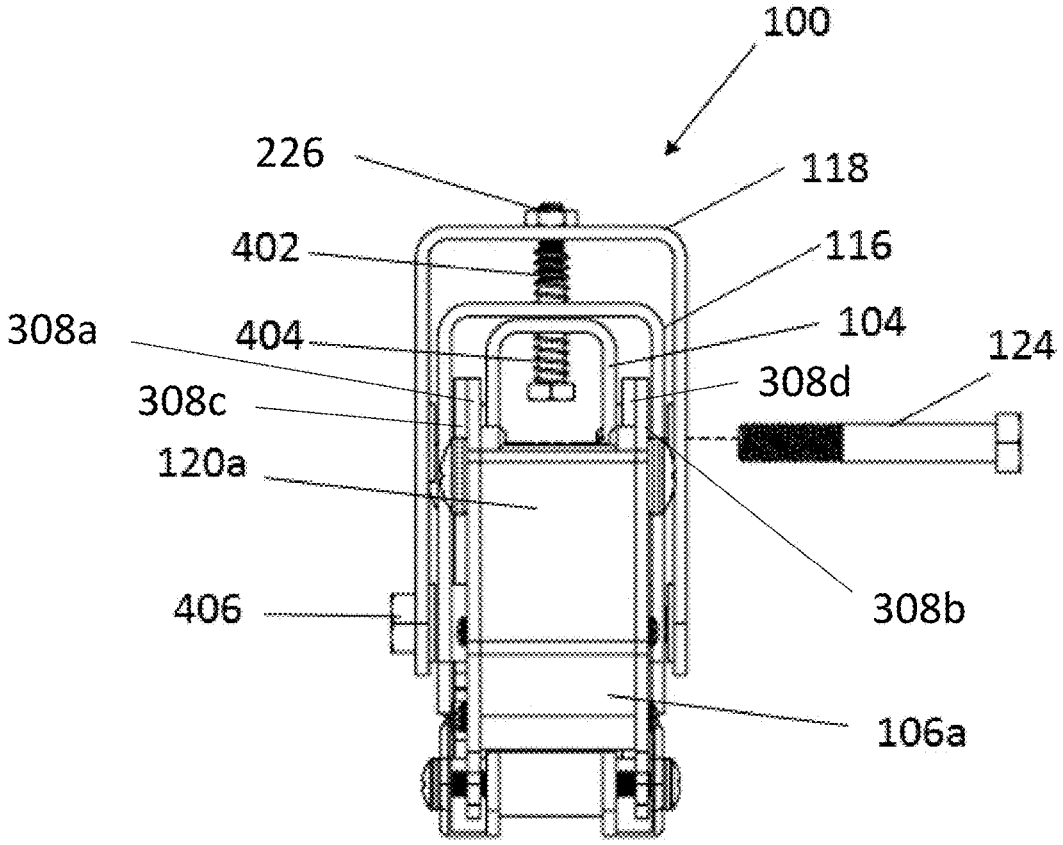
FIG. 4 shows a side view of the locking rotational device of FIG. 1 in a locked mode.
Figure 6:
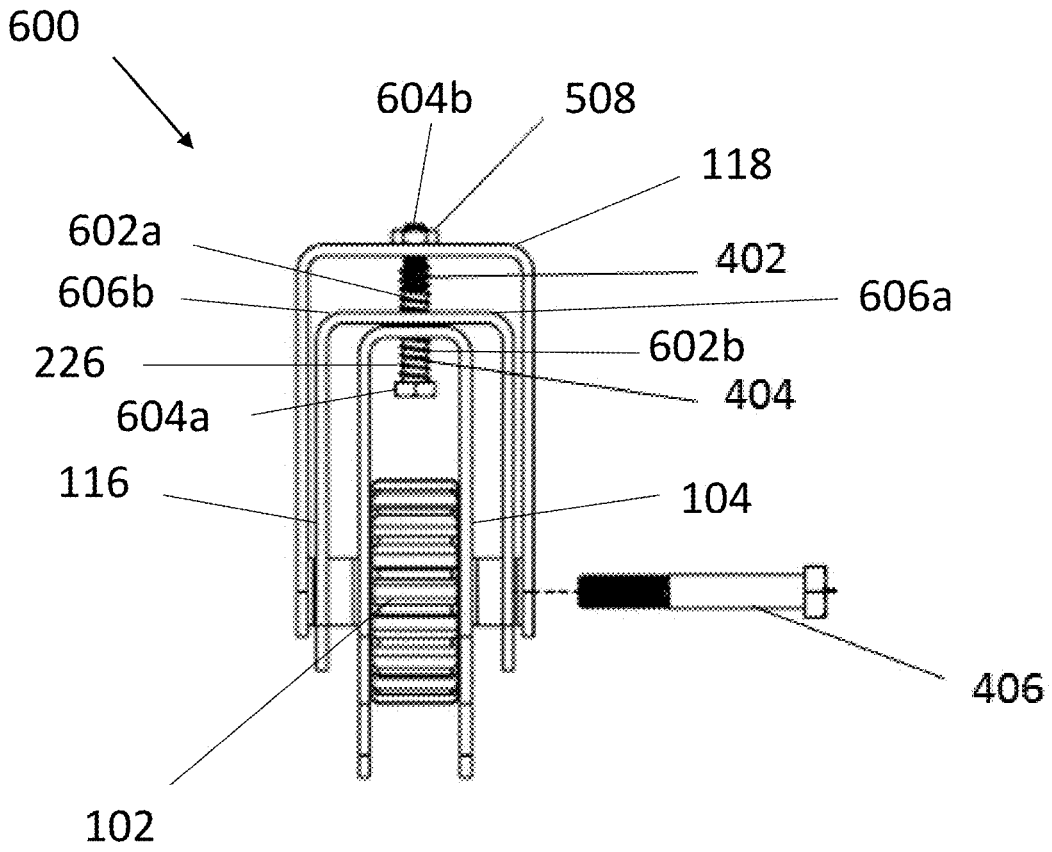
FIG. 6 shows a side view of a portion of the locking rotational device of FIG. 1.

FIG. 4 shows a side view of locking rotational device 100 in the locked mode. As shown in FIG. 4, locking rotational device 100 further includes a first spring 402, a second spring 404, and wheel axel 406. First spring 402 surrounds a first portion 602*a* (as shown in FIG. 6) of bracket guide 226 that is disposed between master bracket 118 and jaw bracket 116, and second spring 404 surrounds a second portion 602*b* (as shown in FIG. 6) of bracket guide 226 that is disposed between wheel bracket 104 and a first end 604*a* (as shown in FIG. 6) of bracket guide 224. Wheel axel 406 extends through a wheel axel channel 304 (shown, in part, in FIG. 3) that passes through each of master bracket 118, jaw bracket 116, wheel bracket 104 and wheel 102, as will be described more fully below. Wheel 102 rotates about wheel axel 406 when locking rotational device 100 is in an unlocked mode, as described more fully below.

FIG. 5 shows an exploded side view of a portion 500 of locking rotational device 100. As shown in FIG. 5, portion 500 includes wheel 102, wheel bracket 104, jaw bracket 116, master bracket 118, bracket guide 226, first spring 402, second spring 404, and nut 508. As also shown in FIG. 5, wheel bracket 104 comprises wheel bracket base 504*a*, first wheel bracket arm 504*b* that extends from first side 506*a* of wheel bracket base 504*a*, and second wheel bracket arm 504*c* that extends from second side 506*b* of wheel bracket base 504*a* and is substantially parallel to first wheel bracket arm 504*b*, wheel 102 being disposed between first wheel bracket arm 504*b* and second wheel bracket arm 504*c*. Jaw bracket 116 comprises a jaw bracket base 516*a*, a first jaw bracket arm 516*b* that extends from a first side 606*a* (as shown in FIG. 6) of jaw bracket base 516*a*, and a second jaw bracket arm 516*c* that extends from a second side 606*c* (as shown in FIG. 6) of jaw bracket base 516*a* and is substantially parallel to first jaw bracket arm 516*b*. Master bracket 118 comprises a master bracket base 518*a*, a first master bracket arm 518*b* that extends from a first side 520*a* of master bracket base 518*a*, and a second master bracket arm 518*c* that extends from a second side 520*b* of master bracket base 518*a* and is substantially parallel to first master bracket arm 518*b*.

As still further shown in FIG. 5, wheel bracket 104 is disposed between first jaw bracket arm 516*b* and second jaw bracket arm 516*c* and jaw bracket 116 is disposed between first master bracket arm 518*b* and second master bracket arm 518*c*. Wheel 102 is disposed between first wheel bracket arm 504*b* and second wheel bracket arm 504*c*.

As shown FIG. 5 and FIG. 6 (described below), bracket guide 226 supports first spring 402 between jaw bracket base 516*a* and master bracket base 518*a*. Bracket guide 226 further supports second spring 404 between wheel bracket base 504*a* and first end 604*a* of bracket guide 226. Bracket guide 226 extends through a bracket guide channel 126 formed in wheel bracket base 504*a*, jaw bracket base 516*a*, and master bracket base 518*a*. First end 604*a* of bracket guide 226 may have a diameter greater than a diameter of a main portion 512 of bracket guide 226. Bracket guide 226 may be secured within bracket guide channel 126 by nut 508 which is attached to a second end 604*b* of bracket guide 226 to align wheel bracket 104, jaw bracket 116 and master bracket 118. Second end 604*b* may comprise a threaded surface onto which nut 508 may be attached to be flush with master bracket base 518*a*. Alternately, bracket guide 226 may extend through bracket guide channel 126 in wheel bracket base 504*a*, jaw bracket base 516*a*, and master bracket base 518*a* in an opposite direction, such that a nut is attached to first end 604*a* of bracket guide 226 to be flush with wheel bracket base 504*a*. Regardless of the direction of bracket guide 226, nut 508 also has a diameter greater than a diameter of main portion 512 of bracket guide 226. Persons skilled in the relevant art(s) will understand that bracket guide 226 is not limited to a screw or to having a threaded end and that other configurations of bracket guides for supporting first spring 402 and second spring 404 and for aligning wheel bracket 104, jaw bracket 116, and master bracket 118 may be used.

Returning now to the descriptions of FIGS. 3 and 4, second end 314*a* of first jaw plate 308*a* and second end 314*c* of third jaw plate 308*c* are disposed between second wheel bracket arm 504*c* and second jaw bracket arm 516*c*. Similarly, second end 314*b* of second jaw plate 308*b* and second end 314*d* of fourth jaw plate 308*d* are disposed between second wheel bracket arm 504*b* and second jaw bracket arm 516*b*. Jaw axel 124 extends through jaw axel channel 302 of FIG. 3 which passes through each of first master bracket arm 518*b*, first jaw bracket arm 516*b*, second end 314*b* of second jaw plate 308*b*, second end 314*d* of fourth jaw plate 308*d*, first wheel bracket arm 504*b*, second wheel bracket arm 504*c*, second end 314*a* of first jaw plate 308*a*, second end 314*c* of third jaw plate 308*c*, second jaw bracket arm 516*c*, and second master bracket arm 518*c*. It should be noted that jaw axel channel 302 in each of first master bracket arm 518*b* and second master bracket arm 518*c* has an elongated shape in a direction substantially parallel to bracket guide 226 to allow jaw axel 124 to move therein. That is, jaw axel channel 302 in each arm of master bracket 118 has a length in a direction substantially parallel to bracket guide 226 that is greater than a diameter of jaw axel 124 to allow jaw axel 124 to move within jaw axel channel 302 in each arm of master bracket 118. Similarly, jaw axel channel 302 in first wheel bracket arm 504*b* and second wheel bracket arm 504*c* has an elongated shape in a direction substantially parallel to bracket guide 226 to allow jaw axel 124 to move therein. That is, jaw axel channel 302 in each arm of wheel bracket 104 has a length in a direction substantially parallel to bracket guide 226 that is greater than a diameter of jaw axel 124 to allow jaw axel 124 to move within jaw axel channel 302 in each arm of wheel bracket 104.

FIG. 6 shows a side view of a portion 600 of locking rotational device 100. As shown in FIG. 6, portion 600 includes wheel 102, wheel bracket 104, jaw bracket 116, master bracket 118, bracket guide 226, nut 508, first spring 402, second spring 404, and wheel axel 406. Wheel axel 406 extends through a corresponding wheel axel channel 304 in each of first master bracket arm 518*b*, first jaw bracket arm 516*b*, first wheel bracket arm 504*b*, wheel 102, second wheel bracket arm 504*c*, second jaw bracket arm 516*c*, and second master bracket arm 518*c*. It should be noted that wheel axel channel 304 in first jaw bracket arm 516*b* and second jaw bracket arm 516*c* has an elongated shape in a direction substantially parallel to bracket guide 226 to allow wheel axel 406 to move therein. That is, wheel axel channel 304 in each arm of jaw bracket 116 has a length in a direction substantially parallel to bracket guide 226 greater than a diameter of wheel axel 406 to allow wheel axel 406 to move within wheel axel channel 304 in each arm of jaw bracket 116. Similarly, wheel axel channel 304 in first wheel bracket arm 504*b* and second wheel bracket arm 504*c* has an elongated shape in a direction substantially parallel to bracket guide 226 to allow wheel axel 406 to move therein. That is, wheel axel channel 304 in each arm of wheel bracket 104 has a length in a direction substantially parallel to bracket guide 226 greater than a diameter of wheel axel 406 to allow wheel axel 406 to move within wheel axel channel 304 in each arm of wheel bracket 104.

Figure 7:
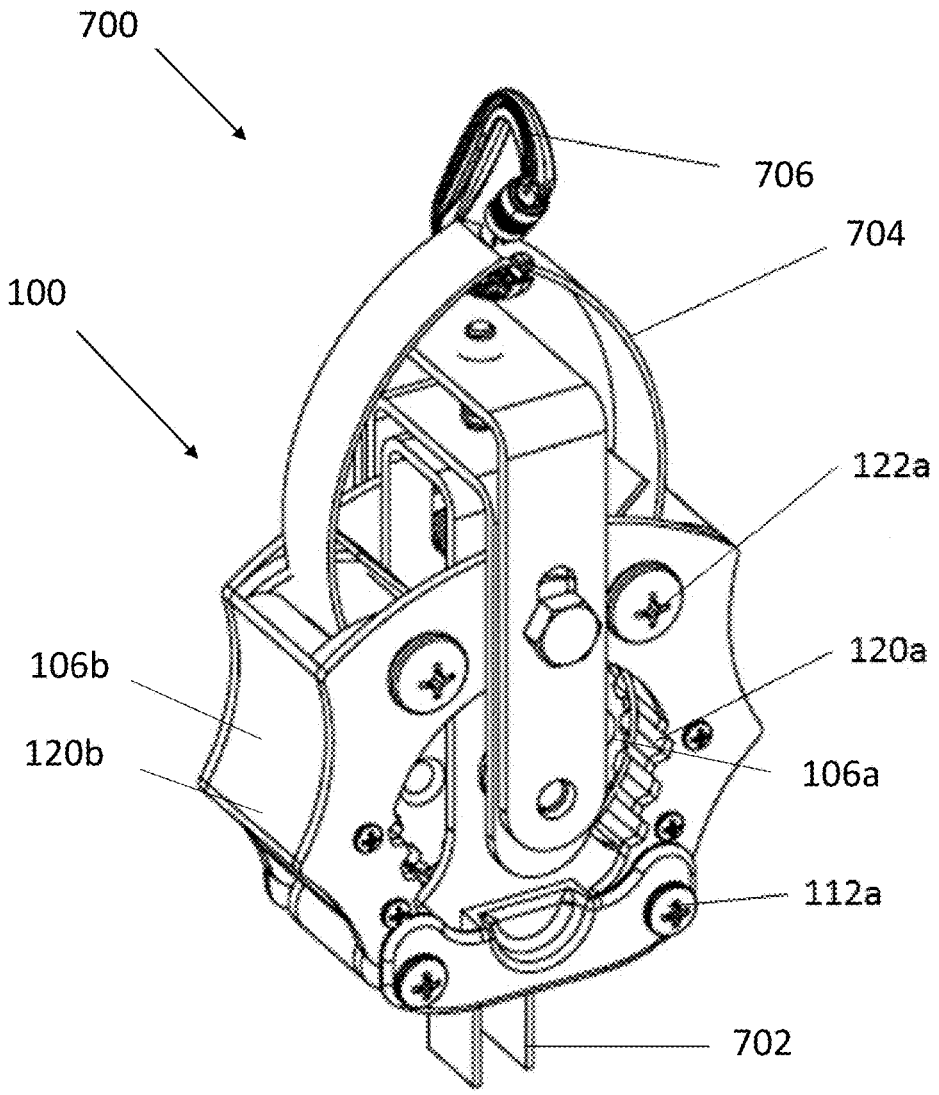
FIG. 7 shows a front isometric view of a locking rotational suspension training system that includes the locking rotational device of FIG. 1 in a locked mode.

FIG. 7 shows a front isometric view of an example of a locking rotational suspension training system 700 that includes locking rotational device 100 in a locked mode. As shown in FIG. 7, locking rotational suspension training system 700 further includes a first strap 702, a second strap 704, and a swivel point connector 706, which are described below.

Figure 8:
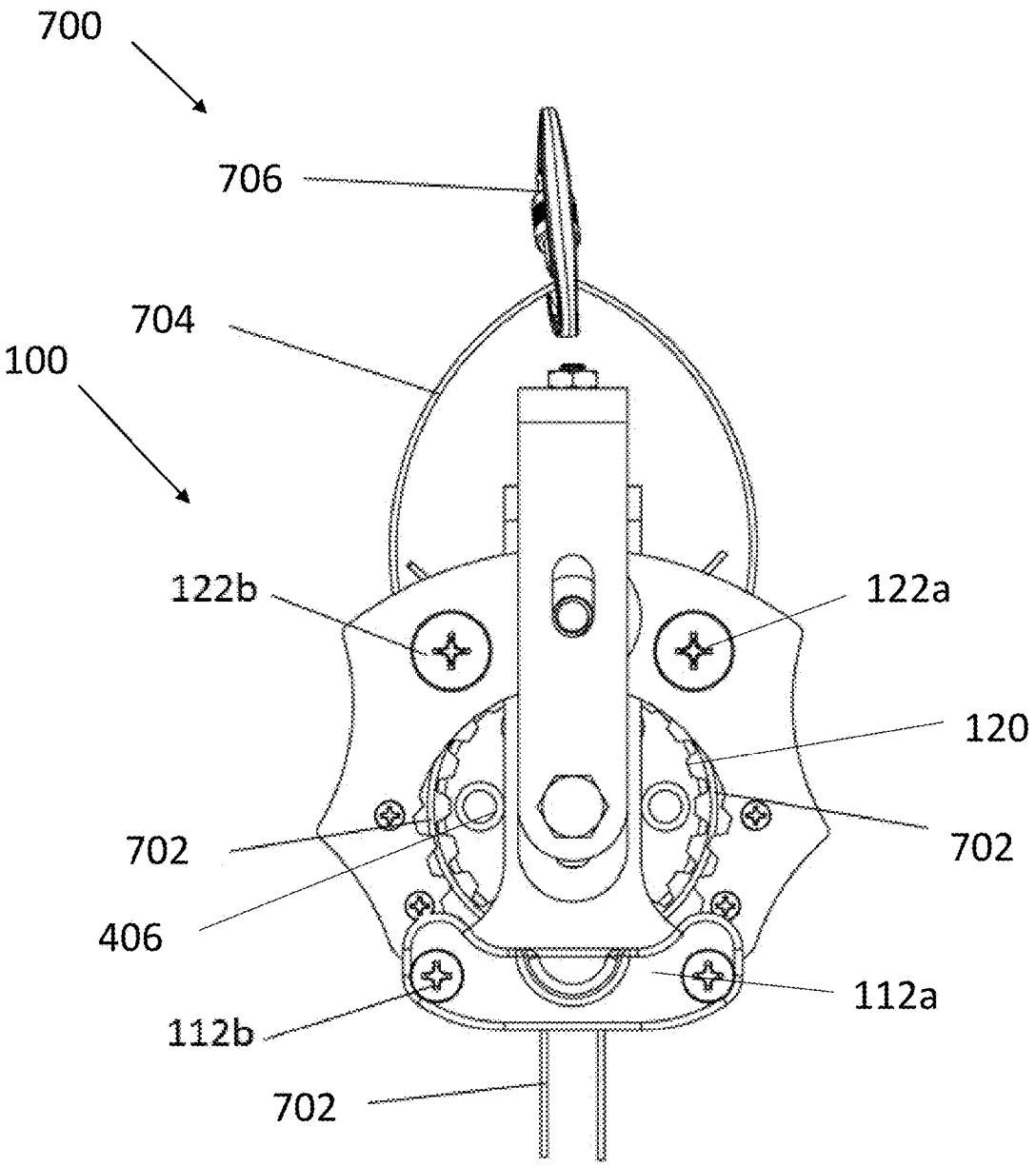
FIG. 8 shows a back view of the locking rotational suspension training system of FIG. 7 that includes the locking rotational device of FIG. 1 in a locked mode.

FIG. 8 shows a perspective view of a back side of locking rotational suspension training system 700 that also includes locking rotational device 100 in a locked mode.

As shown in FIG. 7 and FIG. 8, locking rotational suspension training system 700 includes first strap 702, second strap 704, and swivel point connector 706. Persons skilled in the relevant art(s) will appreciate that locking rotational suspension training system 700 is not limited to using a strap and that a cable or cord may also be used with similar results. However, for the remainder of this document, the word "strap" is used for ease of description. First strap 702 is arranged to extend around a portion of wheel 102 and between first locking pin 112*a* and second locking pin 112*b*. First strap 702 extends between wheel 102 and first wheel brake 120*a* and between wheel 102 and second wheel brake 120*b*. In essence, first strap 702 is draped over wheel 102 in an unlocked mode of operation, and clamped between wheel 102 and first brake 120*a* and between wheel 102 and second brake 120*b* in a locked mode of operation, as described more fully below.

As further shown in FIG. 7 and FIG. 8, second strap 704 extends around wheel bracket 104, jaw bracket 116, and master bracket 118, and is supported by first suspension pin 122*a* and second suspension pin 122*b*. In a non-limiting embodiment, either end of second strap 704 is connected to a corresponding suspension pin by having loops that are sewn, or attached by Velcro or adhesive, around the corresponding suspension pin. In another non-limiting embodiment, either end of second strap 704 is connected to a corresponding suspension pin using a connector such as a hook or carabiner or other type of connector. In yet another non-limiting embodiment, second strap 704 forms a loop around wheel bracket 104, jaw bracket 116, master bracket 118, first suspension pin 122*a* and second suspension pin 122*b*, and either end of second strap 704 is sewn to the other or are otherwise connected together such as by adhesive or Velcro or some other means of attachment. Swivel point connector 706 is removably attached to second strap 704. For some exercises, a user may wish to attach swivel point connector 706 to second strap 704 at substantially a center of second strap 704, but this is not necessary. Swivel point connector 706 is configured to affix locking rotational device 100 to another object, such as a bar or any other object (not shown), while allowing locking rotational device 100 to swivel. Although swivel point connector 706 is shown in FIG. 7 and FIG. 8 as a carabiner, persons skill in the relevant art(s) will appreciate that swivel point connector 706 is not limited to being a carabiner and that other types of connectors that allow locking rotational device 100 to be attached to another object may be used. It should also be noted that a first strap, a second strap, and/or a swivel point connector can be combined with locking rotational device 100 shown in FIGS. 1-6 in a same manner as described above with respect to locking rotational suspension training system 700 with similar results.

B. Materials

All components of locking rotational suspension training system 700 and locking rotational device 100 may be formed of a metal, a plastic, a polymer, or a combination thereof. A hardness or strength of the metal, plastic, polymer, or combination may be altered to comply with a desired load bearing capacity of the device and to withstand a certain amount of torque on the device. Similarly, sizes of the components of locking rotational device 100 may be altered to comply with a desired load bearing capacity of the device and to withstand a certain amount of torque on the device. In a non-limiting embodiment, first and second wheel brakes 120*a* and 120*b* may be formed of a hard rubber, although other materials may be used; wheel bracket 104, jaw bracket 116, master bracket 118, first jaw component 106*a* and second jaw component 106*b* may be formed of aluminum or another metal or material; first and second grips 110*a* and 110*b*, first and second wheel brakes 120*a* and 120*b*, and wheel 102 may be formed of nylon, although other materials may be used. In some non-limiting embodiments, all rods, pins, axels, screws and nuts may be formed of a metal such as stainless steel or aluminum, although other metals or materials may be used. First and second straps 702 and 704 may be formed of a cable, nylon, or hard rubber, although other materials may be used. In some non-limiting embodiments, first and second straps 702 and 704 may be formed such that first and second straps 702 and 704 provide some bounce or spring when stretched and released. In some non-limiting embodiments, jaw axel 124 and wheel axel 406 may be formed to be smooth and to have a low coefficient of friction.

All components of locking rotational suspension training system 700 and locking rotational device 100 may be 3D printed, carved using computer numerical control, injection molded, or machined. This list is not exhaustive, however, and persons skilled in the relevant art(s) will understand that other methods of manufacturing the components of locking rotational suspension training system 700 and locking rotational device 100 may be used.

C. Operation of a Locking Rotational Device

Operation of locking rotational suspension training system 700 and locking rotational device 100 will now be described with continued reference to FIGS. 1-8. As previously noted, locking rotational suspension training system 700 and locking rotational device 100 each have two modes of operation, an unlocked mode and a locked mode. First, an unlocked mode will be described, and then a locked mode will be described. Finally, transitioning between the locked mode and the unlocked mode will be described.

1. Unlocked Mode

A configuration of locking rotational suspension training system 700 and locking rotational device 100 in an unlocked mode will now be described. Locking rotational device 100 is shown in an unlocked mode in FIGS. 1 and 3. However, reference may be made in this section to any of the elements shown in FIGS. 1-8. Furthermore, it should be noted that this description applies equally to locking rotational suspension training system 700. In an unlocked mode, first connector 310*a* and second connector 310*b* are disengaged from first locking pin 112*a* and third connector 310*c* and fourth connector (not shown) are disengaged from second locking pin 112*b* allowing first jaw component 106*a* and second jaw component 106*b* to rotate away from wheel 102. Rotation of first jaw component 106*a* and second jaw component 106*b* away from wheel 102 causes first wheel brake 120*a* and second wheel brake 120*b* to move away from wheel 102, allowing wheel 102 to rotate freely about wheel axel 406. Since first strap 702 is essentially draped over wheel 102 in the unlocked mode, rotation of wheel 102 allows first strap 702 to move freely through locking rotational device 100.

2. Locked Mode

A configuration of locking rotational suspension training system 700 and locking rotational device 100 in a locked mode will now be described. Locking rotational device 100 is shown in a locked mode in FIGS. 2 and 4 and locking rotational suspension training system 700 is shown in a locked mode in FIGS. 7 and 8. However, reference may be made in this section to any of the elements shown in FIGS. 1-8. Furthermore, it should be noted that this description applies equally to locking rotational device 100 and locking rotational suspension training system 700. In a locked mode, first connector 310*a* and second connector 310*b* are engaged with (or connected or fastened to) first locking pin 112*a* and third connector 310*c* and fourth connector (not shown) are engaged with (or connected or fastened to) second locking pin 112*b*. As a non-limiting example, first locking pin 112*a* and second locking pin 112*b* may be comprised of a hollow roller having a bar or screws extending there through. First connector 310*a* and second connector 310*b*, and third connector 310*c* and fourth connector (not shown) may hook onto either end of the bars or screws that extend through the rollers. In an alternate, non-limiting embodiment, first connector 310*a* and second connector 310*b*, and third connector 310*c* and fourth connector (not shown) may hook onto the rollers themselves. Although FIG. 3 illustrates first-third connectors 310*a*-310*c* as "hooks," and locking pins 112*a* and 112*b* as "pins," persons of ordinary skill in the art will understand that first-third connectors 310*a*-310*c* and fourth connector (not shown) are not limited to being "hooks" and locking pins 112*a* and 112*b* are not limited to being "pins." That is, any type of connectors or fasteners capable of connecting first jaw plate 308*a* and second jaw plate 308*b*, respectively, to first wheel bracket arm 504*b* and second wheel bracket arm 504*c*, may be used. Similarly, any type of connectors or fasteners capable of connecting third jaw plate 308*c* and fourth jaw plate 308*d*, respectively, to first wheel bracket arm 504*b* and second wheel bracket arm 504*c*, may be used. As non-limiting examples, such connections may be made using a hook and eye or snap-like approach.

Attaching first connector 310*a* and second connector 310*b* to first locking pin 112*a* and third connector 310*c* and fourth connector (not shown) to second locking pin 112*b* results in first jaw component 106*a* and second jaw component 106*b* closing around wheel 102. First wheel brake 120*a* and second wheel brake 120*b* clamp down around wheel 102 and prevent wheel 102 from rotating in the locked mode. Since first strap 702 is positioned between wheel 102 and first wheel brake 120*a* and between wheel 102 and second wheel brake 120*b*, first strap 702 is held statically, in a fixed position, between wheel 102 and first wheel brake 120*a* and between wheel 102 and second wheel brake 120*b*, in the locked mode. As illustrated in FIG. 3, as a non-limiting example, an outer wheel edge 502*c* of wheel 102 may have alternating notches and grooves formed thereon, and an edge of first wheel brake 120*a* and an edge of second wheel brake 120*b* may have alternating notches and grooves formed thereon. Notches of outer wheel edge 502*c* of wheel 102 may engage with the grooves of the edges of first wheel brake 120*a* and second wheel brake 120*b* when in the locked mode, ensuring a firm grip there between and preventing slippage of strap 702. Persons skilled in the relevant art(s) will readily understand that a pattern of notches and grooves is not required and that other methods of ensuring a tight grip between wheel 102 and wheel brakes 120*a* and 120*b* may be used.

3. Transitioning Between Locked Mode and Unlocked Mode

Locking rotational suspension system 700 and/or locking rotational device 100 can be transitioned from a locked mode to an unlocked mode by pulling on first grip 110*a* and second grip 110*b* in a direction substantially parallel to bracket guide 226 and away from any of the bracket bases. Wheel axel channel 304 in jaw bracket 118 has a length in a direction substantially parallel to bracket guide 226 larger than a diameter of wheel axel 406 thereby allowing wheel axel 406 to slide therein in the direction substantially parallel to the bracket guide 226. When first grip 110*a* and second grip 110*b* are pulled in a direction substantially parallel to bracket guide 226 and away from the bracket bases, wheel bracket 104 moves down compressing second spring 404 and allowing first jaw component 106*a* and second jaw component 106*b* to move. In addition, first and second jaw components 106*a* and 106*b* may be pulled up by second strap 704 when first grip 110*a* and second grip 110*b* are pulled down. Further still, the elongated channels that allow sliding of the jaw axel 124 and wheel axel 406 allow for a telescoping extension of the device in a direction substantially parallel to the bracket guide when the user pulls downward on first and second grips 110*a* and 110*b*. This telescoping extension is what enables first connector 310*a* and second connector 310*b* at the first ends 312*a* and 312*b* of first and second jaw plates 108*a* and 108*b* to be decoupled from first locking pin 112*a* and second locking pin 112*b*, respectively. Hence, pulling first grip 110*a* down allows first connector 310*a* and second connector 310*b* to disengage from first locking pin 112*a*. Similarly, pulling second grip 110*b* down allows third connector 310*c* and fourth connector (not shown) to disengage from second locking pin 112*b*. In turn, first jaw component 106*a* and second jaw component 106*b* are freed to rotate about jaw axel 124 away from wheel 102, thereby removing first and second wheel brakes 120*a* and 120*b* from wheel 102 allowing wheel 102 to rotate freely about wheel axel 406. When wheel 102 can rotate freely, strap 702 can move freely within locking rotational device 100 and/or locking rotational suspension system 700.

Locking rotational suspension system 700 and/or locking rotational device 100 can be transitioned from an unlocked mode to a locked mode by squeezing first jaw bracket 106*a* and second jaw bracket 106*b*. Squeezing first jaw bracket 106*a* and second jaw bracket 106*b* allows first and second connectors 310*a* and 310*b* to engage with first locking pin 112*a* and third connector 310*c* and fourth connector (not shown) to engage with second locking pin 112*b*. Once first connector 310*a* and second connector 310*b* are engaged with first locking pin 112*a* and third connector 310*c* and fourth connector (not shown) are engaged with second locking pin 112*b*, first jaw component 106*a* and second jaw component 106*b* clamp down around wheel 102 thereby applying pressure by first wheel brake 120*a* and second wheel brake 120*b* to wheel 102. When first jaw component 106*a* and second jaw component 106*b* are clamped down around wheel 102, wheel 102 is prevented from rotating and first strap 702 is fixed statically between wheel 102 and first wheel brake 120*a* and between wheel 102 and second wheel brake 120*b*. It should be noted that locking rotational device 100 and locking rotational suspension system 700 can be locked at any position along first strap 702, thereby allowing a user to have two strap "running ends" of any length(s) permitted by strap 702. It should be further noted that handles 902*a* and 902*b* (shown in FIG. 9) may be attached to the two strap running ends, which may serve as handholds, footholds, or any other suitable purpose, such as to hold a weight or weights.

D. Example Applications

As previously noted, locking rotational suspension training system 700 and locking rotational device 100 are configured to allow first strap 702 to move freely with wheel 102 in an unlocked mode and to fix strap 702 statically at any point along its length in a locked mode. When used as a suspension training system, locking rotational suspension training system 700 and locking rotational device 100 allow a user to engage in a full range of body weight rotational, static, symmetric and asymmetric exercises as well as weighted "pulley type" exercises.

Figure 9:
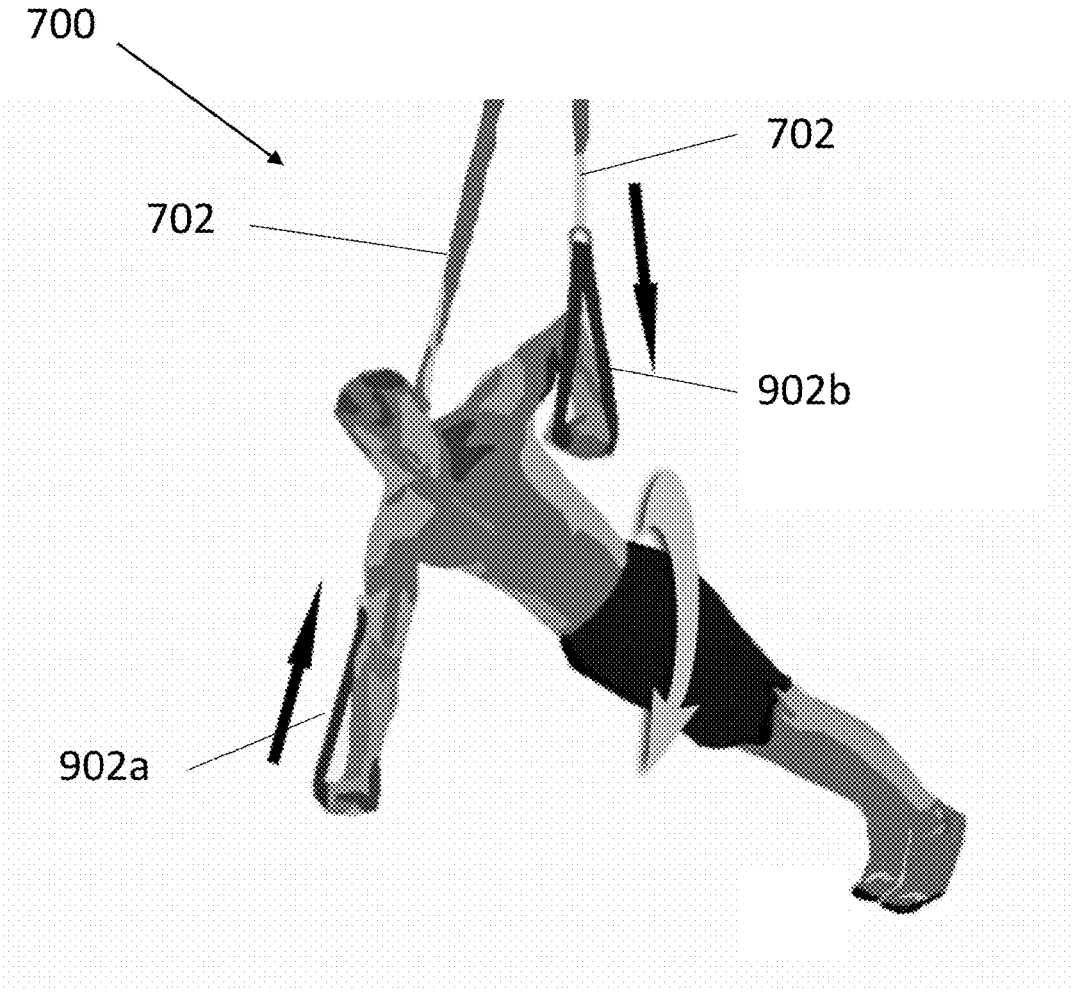
FIG. 9 shows a method of using the locking rotational suspension training system of FIG. 7 to perform rotational exercises.

FIG. 9 shows a method of using locking rotational suspension training system 700 to perform rotational exercises. To perform rotational exercises, a user places locking rotational device 100 (not shown) in the unlocked mode (see FIG. 1). As shown in FIG. 9, the user grips one of two handles 902*a* and 902*b* in each hand. The user then either fully or partially suspends him or herself from first strap 702 and executes an opted for exercise by pulling on one handle so that one end of strap 702 is pushed down while the other end of strap 702 is allowed to be pulled up, thereby causing the user's torso to rotate. At the peak of the movement, the motion is reversed and repeated.

Figure 10:
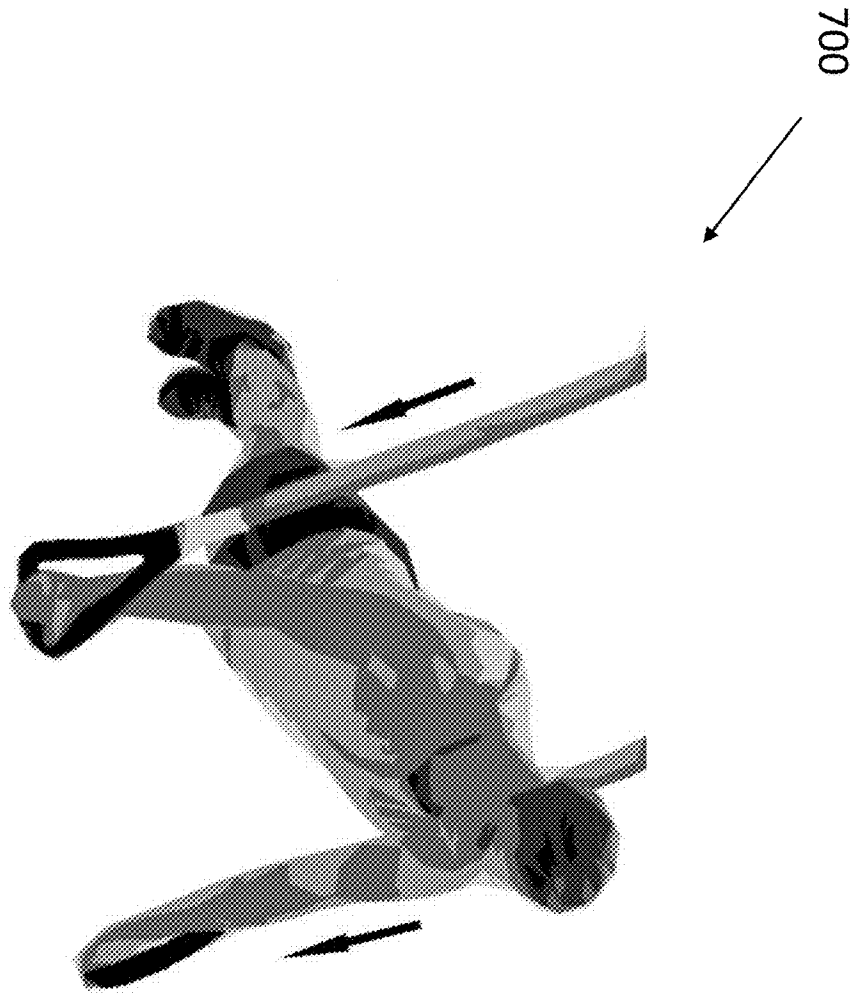
FIG. 10 shows a method of using the locking rotational suspension training system of FIG. 7 to perform unstable exercises.

FIG. 10 shows a method of using locking rotational suspension training system 700 to perform unstable exercises. To perform unstable exercises, a user places locking rotational device 100 (not shown) in the unlocked mode (see FIG. 1). As shown in FIG. 10, the user grips one of two handles 902*a* and 902*b* in each hand. The user then either fully or partially suspends him or herself from first strap 702 and exerts equal force (in terms of both amount and direction) on the handles in an attempt to push or pull (depending on the movement) him or herself up. At the peak of the movement the motion is reversed and repeated. The unlocked position of locking rotational device 100 ensures equal force is being exerted against each handle.

Figure 11:
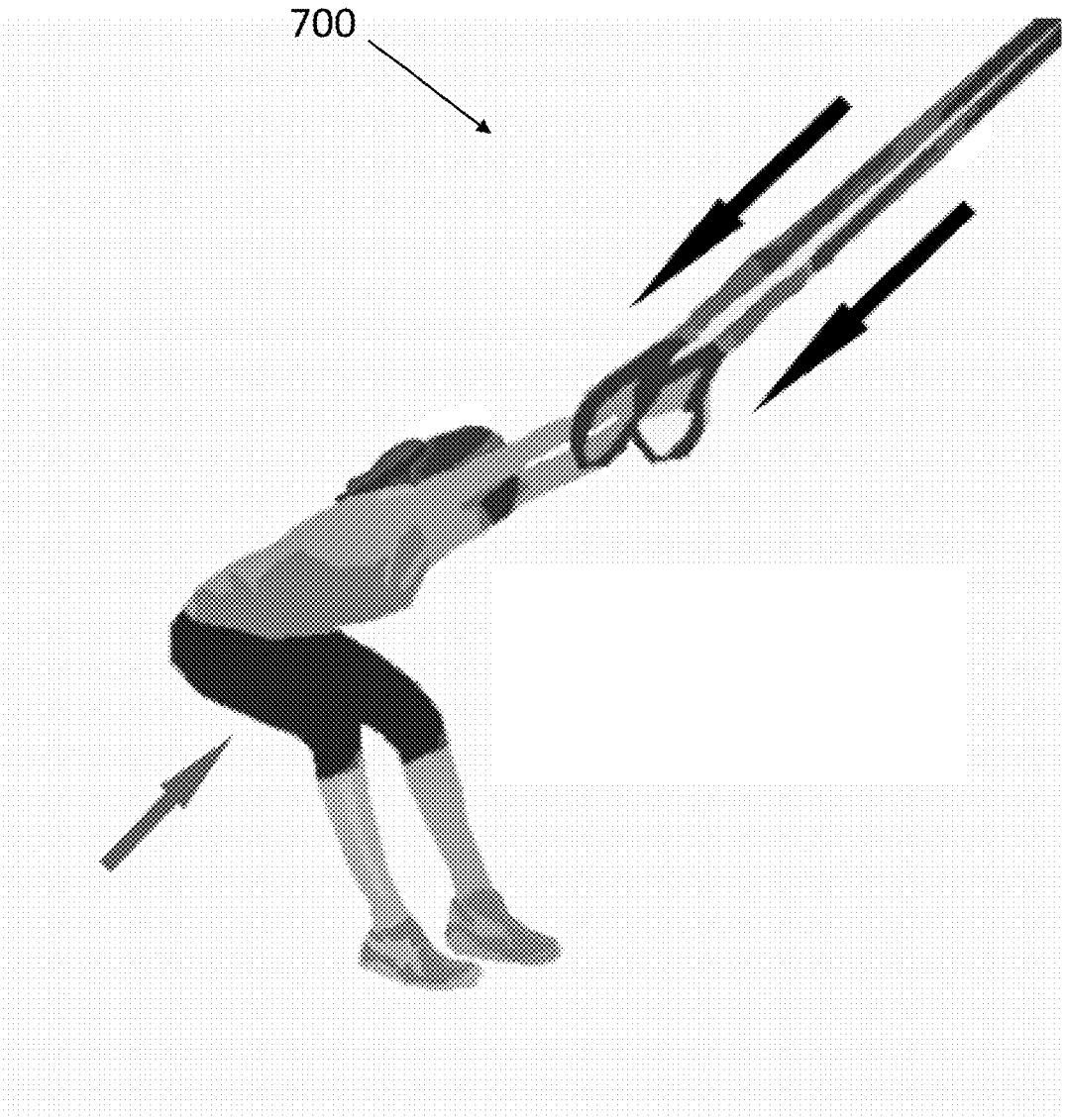
FIG. 11 shows a method of using the locking rotational suspension training system of FIG. 7 to perform static symmetrical exercises.

FIG. 11 shows a method of using locking rotational suspension training system 700 to perform static symmetrical exercises. To perform static symmetrical exercises, a user places locking rotational device 100 (not shown) in the locked mode (see FIG. 2), so that each running end of strap 702 is equal in length. As shown in FIG. 11, the user grips one of two handles 902*a* and 902*b* in each hand. The user then either fully or partially suspends him or herself from first strap 702 and exerts force on the handles in an attempt to push or pull (depending on the movement) him or herself up. At the peak of the movement the motion is reversed and repeated.

Figure 12:
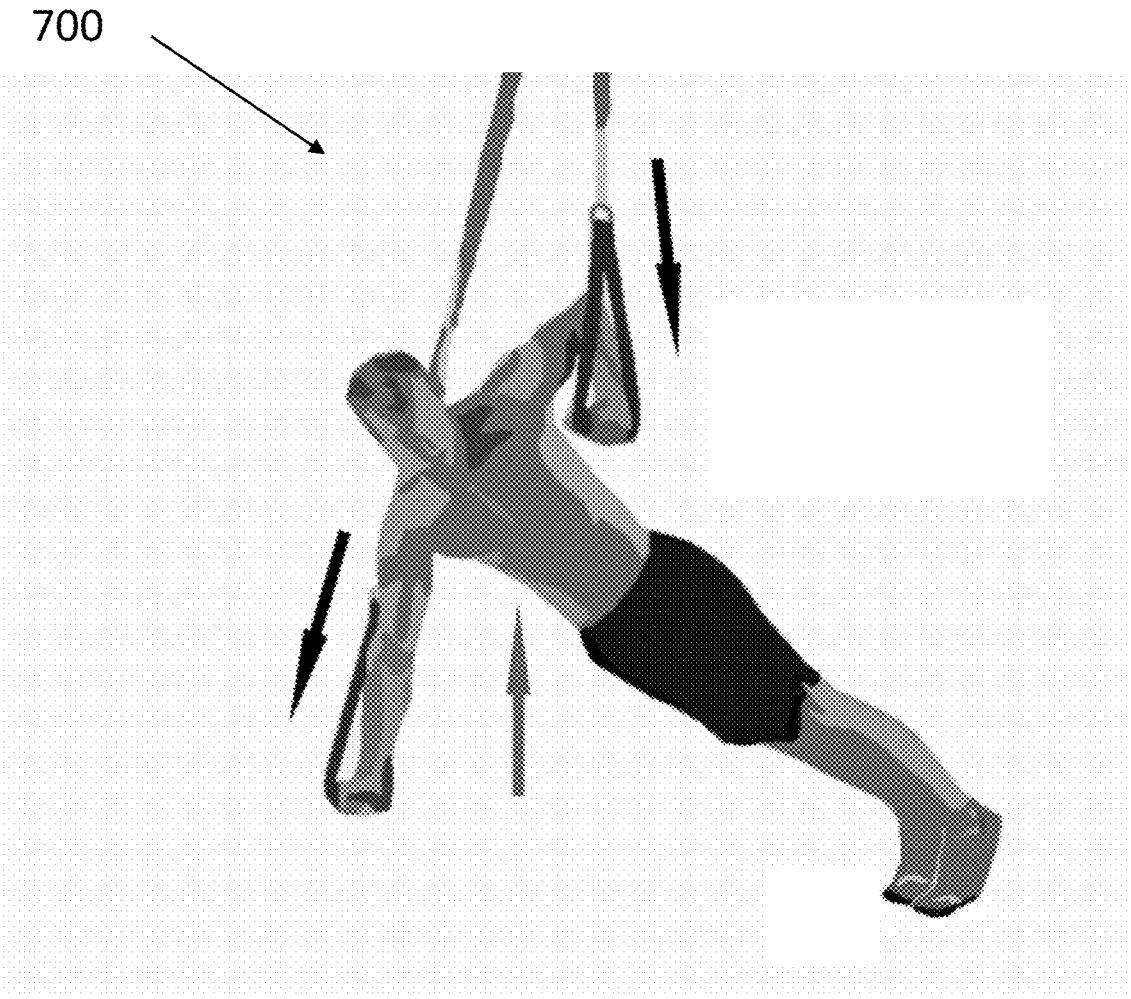
FIG. 12 shows a method of using the locking rotational suspension training system of FIG. 7 to perform static asymmetrical exercises.

FIG. 12 shows a method of using locking rotational suspension training system 700 to perform static asymmetrical exercises. To perform static asymmetrical exercises, a user places locking rotational device 100 (not shown) in the locked mode (see FIG. 2), so that each running end of strap 702 is unequal in length. As shown in FIG. 11, the user grips one of two handles 902*a* and 902*b* in each hand. The user then either fully or partially suspends him or herself from first strap 702 and exerts force on the handles in an attempt to push or pull (depending on the movement) him or herself up. At the peak of the movement the motion is reversed and repeated.

Figure 13:
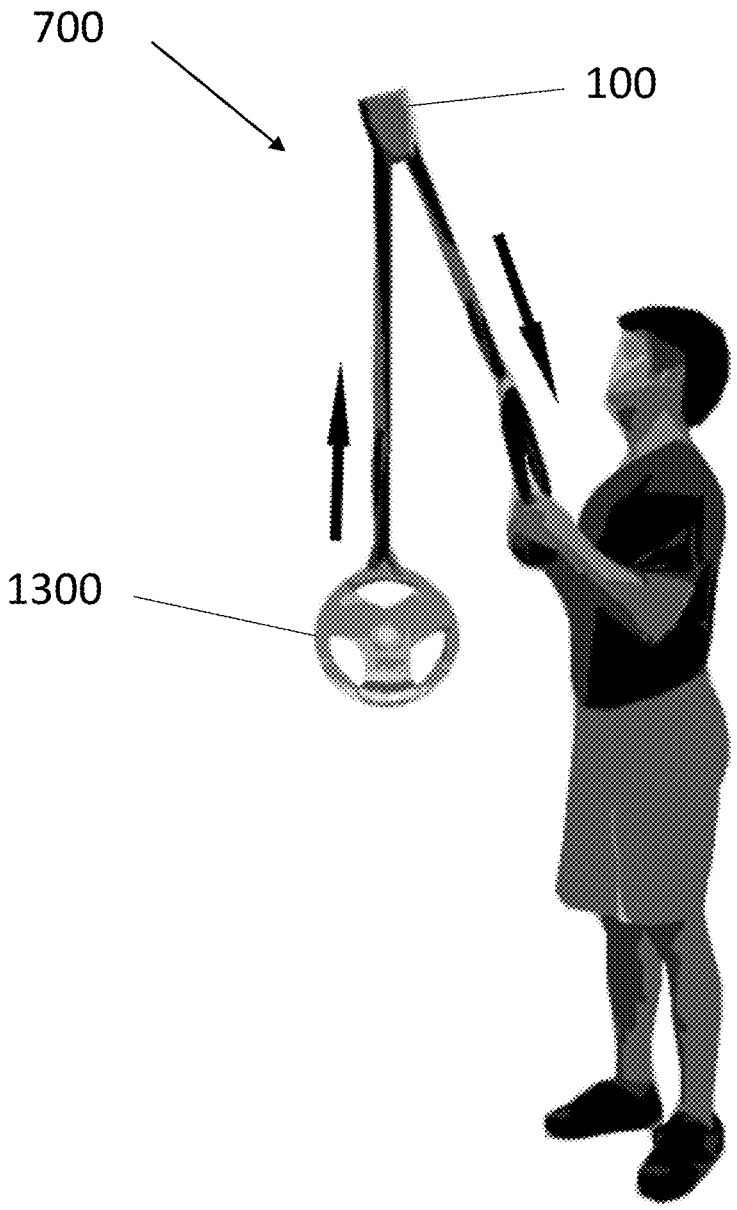
FIG. 13 shows a method of using the locking rotational suspension training system of FIG. 7 to perform suspended weight exercises.

FIG. 13 shows a method of using locking rotational suspension training system 700 to perform suspended weight exercises. To perform suspended weight exercises, a user places locking rotational device 100 (not shown) in the unlocked mode (see FIG. 1). As shown in FIG. 13, the user secures one running end of the strap to a weight 1300 or other source of resistance (i.e., resistance bands) and grips the handle 902*a* or 902*b* at the other running end of strap 702. The user then exerts force on the handle to move the source of resistance. At the peak of the movement the motion is reversed and repeated.

As shown, locking rotational suspension training system 700 and locking rotational device 100 allow a user to perform a breadth of exercises not previously made possible by conventional suspension training systems.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A locking rotational suspension training system comprising:

a device comprising:

a wheel;

a wheel bracket comprising a wheel bracket base, a first wheel bracket arm that extends from a first side of the wheel bracket base, and a second wheel bracket arm that extends from a second side of the wheel bracket base and is substantially parallel to the first wheel bracket arm, the wheel being disposed between the first wheel bracket arm and the second wheel bracket arm;

a first locking pin that is connected to and disposed between a first side of a first end of the first wheel bracket arm and a first side of a first end of the second wheel bracket arm;

a second locking pin that is connected to and disposed between a second side of the first end of the first wheel bracket arm and a second side of the first end of the second wheel bracket arm;

a first grip that is attached to the first end of the first wheel bracket arm;

a second grip that is attached to the first end of the second wheel bracket arm;

a first jaw component comprising a first jaw plate, a second jaw plate that is substantially parallel to the first jaw plate, and a first wheel brake that is connected to and disposed between the first jaw plate and the second jaw plate, a first end of the first jaw plate comprising a first connector and a first end of the second jaw plate comprising a second connector, the first and second connectors being configured to engage with the first locking pin to place the first jaw component in a locked position and to disengage from the first locking pin to place the first jaw component in an unlocked position;

a second jaw component comprising a third jaw plate, a fourth jaw plate that is substantially parallel to the third jaw plate, and a second wheel brake that is connected to and disposed between the third jaw plate and the fourth jaw plate, a first end of the third jaw plate comprising a third connector and a first end of the fourth jaw plate comprising a fourth connector, the third and fourth connectors being configured to engage with the second locking pin to place the second jaw component in a locked position and to disengage from the second locking pin to place the second jaw component in an unlocked position;

a jaw bracket comprising a jaw bracket base, a first jaw bracket arm that extends from a first side of the jaw bracket base, and a second jaw bracket arm that extends from a second side of the jaw bracket base and is substantially parallel to the first jaw bracket arm, a second end of the first jaw plate and a second end of the third jaw plate being disposed between the first wheel bracket arm and the first jaw bracket arm, and a second end of the second jaw plate and a second end of the fourth jaw plate being disposed between the second wheel bracket arm and the second jaw bracket arm;

a master bracket comprising a master bracket base, a first master bracket arm that extends from a first side of the master bracket base, and a second master bracket arm that extends from a second side of the master bracket base, the jaw bracket being disposed between the first master bracket arm and the second master bracket arm;

a jaw axel that extends through a corresponding jaw axel channel in each of the first master bracket arm, the first jaw bracket arm, the second end of the first jaw plate, the second end of the third jaw plate, the first wheel bracket arm, the second wheel bracket arm, the second end of the fourth jaw plate, the second end of the second jaw plate, the second jaw bracket arm, and the master bracket arm;

a wheel axel that extends through a corresponding wheel axel channel in each of the first master bracket arm, the first jaw bracket arm, the first wheel bracket arm, the wheel, the second wheel bracket arm, the second jaw bracket arm, and the second master bracket arm;

a bracket guide that extends through a corresponding bracket guide channel in each of the master bracket base, the jaw bracket base, and the wheel bracket base;

a first spring surrounding the bracket guide between the master bracket and the jaw bracket; and a second spring surrounding the bracket guide between the wheel bracket and a first end of the bracket guide;

the first and second grips being configured to transition the device from a locked mode to an unlocked mode by pulling on the first and second grips in a direction substantially parallel to the bracket guide, the wheel axel channel in the jaw bracket having a length in the direction substantially parallel to the bracket guide larger than a diameter of the wheel axel allowing the wheel axel to slide therein in the direction substantially parallel to the bracket guide, and the jaw axel channel in the master bracket having a length in the direction substantially parallel to the bracket guide larger than a diameter of the jaw axel allowing the jaw axel to slide therein in the direction substantially parallel to the bracket guide; and the device configured to accommodate a first strap arranged to extend around a portion of the wheel and between the first locking pin and the second locking pin, the first strap extending between the wheel and the first wheel brake and between the wheel and the second wheel brake, the first and second wheel brakes clamping down and holding the strap statically against the wheel preventing wheel rotation in the locked mode, and the first and second wheel brakes being positioned away from the wheel permitting the strap to move freely around the wheel and the wheel to rotate in the unlocked mode.

2. The system of claim 1, wherein the system is further configured to accommodate a second strap supported by a pair of suspension pins, the pair of suspension pins being disposed above the first and second wheel brakes, respectively, and connected between the first jaw plate and the third jaw plate and between the second jaw plate and the fourth jaw plate, respectively.

3. The system of claim 2, wherein the system is further configured to accommodate a swivel point connector removably attached to the second strap, the swivel point connector configured to affix the device to another object, and to allow the device to swivel.

4. The system of claim 1, wherein the first wheel bracket arm comprises first and second fins that fan out in opposite directions from the first end of the first wheel bracket arm, the second wheel bracket arm has third and fourth fins that fan out in opposite directions from the first end of the second wheel bracket arm, the first, second, third and fourth fins extending in a direction substantially parallel to first and second wheel sides of the wheel, the first locking pin extending through a corresponding first locking pin channel in the first fin and the third fin, and the second locking pin extending through a corresponding second locking pin channel in the second fin and the fourth fin.

5. The system of claim 1, wherein an outer wheel edge of the wheel has alternating notches and grooves formed thereon, and an edge of the first wheel brake and an edge of the second wheel brake have alternating notches and grooves formed thereon, wherein the notches of the outer wheel edge of the wheel engage the grooves of the edge of the first wheel brake and the second wheel brake, respectively, in the locked mode.

6. The system of claim 1, wherein the second spring is compressed in the locked mode and decompressed in the unlocked mode.

7. The system of claim 1, wherein the bracket guide has a first end having a diameter greater than a diameter of a main portion of the bracket guide, and the second spring is positioned between the wheel bracket base and the first end of the bracket guide.

8. A locking rotational suspension training system comprising:

a device comprising:

a wheel;

a wheel bracket comprising a wheel bracket base, a first wheel bracket arm that extends from a first side of the wheel bracket base, and a second wheel bracket arm that extends from a second side of the wheel bracket base and is substantially parallel to the first wheel bracket arm, the wheel being disposed between the first wheel bracket arm and the second wheel bracket arm;

a first locking pin that is connected to and disposed between a first side of a first end of the first wheel bracket arm and a first side of a first end of the second wheel bracket arm;

a second locking pin that is connected to and disposed between a second side of the first end of the first wheel bracket arm and a second side of the first end of the second wheel bracket arm;

a first grip that is attached to the first end of the first wheel bracket arm;

a second grip that is attached to the first end of the second wheel bracket arm;

a first jaw component comprising a first jaw plate, a second jaw plate that is substantially parallel to the first jaw plate, and a first wheel brake that is connected to and disposed between the first jaw plate and the second jaw plate, a first end of the first jaw plate comprising a first connector and a first end of the second jaw plate comprising a second connector, the first and second connectors being configured to engage with the first locking pin to place the first jaw component in a locked position and to disengage from the first locking pin to place the first jaw component in an unlocked position;

a second jaw component comprising a third jaw plate, a fourth jaw plate that is substantially parallel to the third jaw plate, and a second wheel brake that is connected to and disposed between the third jaw plate and the fourth jaw plate, a first end of the third jaw plate comprising a third connector and a first end of the fourth jaw plate comprising a fourth connector, the third and fourth connectors being configured to engage with the second locking pin to place the second jaw component in a locked position and to disengage from the second locking pin to place the second jaw component in an unlocked position;

a jaw bracket comprising a jaw bracket base, a first jaw bracket arm that extends from a first side of the jaw bracket base, and a second jaw bracket arm that extends from a second side of the jaw bracket base and is substantially parallel to the first jaw bracket arm, a second end of the first jaw plate and a second end of the third jaw plate being disposed between the first wheel bracket arm and the first jaw bracket arm, and a second end of the second jaw plate and a second end of the fourth jaw plate being disposed between the second wheel bracket arm and the second jaw bracket arm;

a master bracket comprising a master bracket base, a first master bracket arm that extends from a first side of the master bracket base, and a second master bracket arm that extends from a second side of the master bracket base, the jaw bracket being disposed between the first master bracket arm and the second master bracket arm;

a jaw axel that extends through a corresponding jaw axel channel in each of the first master bracket arm, the first jaw bracket arm, the second end of the first jaw plate, the second end of the third jaw plate, the first wheel bracket arm, the second wheel bracket arm, the second end of the fourth jaw plate, the second end of the second jaw plate, the second jaw bracket arm, and the master bracket arm;

a wheel axel that extends through a corresponding wheel axel channel in each of the first master bracket arm, the first jaw bracket arm, the first wheel bracket arm, the wheel, the second wheel bracket arm, the second jaw bracket arm, and the second master bracket arm;

a bracket guide that extends through a corresponding bracket guide channel in each of the master bracket base, the jaw bracket base, and the wheel bracket base;

a first spring surrounding the bracket guide between the master bracket and the jaw bracket; and a second spring surrounding the bracket guide between the wheel bracket and a first end of the bracket guide;

the first and second grips being configured to transition the device from a locked mode to an unlocked mode by pulling on the first and second grips in a direction substantially parallel to the bracket guide, the wheel axel channel in the jaw bracket having a length in the direction substantially parallel to the bracket guide larger than a diameter of the wheel axel allowing the wheel axel to slide therein in the direction substantially parallel to the bracket guide, and the jaw axel channel in the master bracket having a length in the direction substantially parallel to the bracket guide larger than a diameter of the jaw axel allowing the jaw axel to slide therein in the direction substantially parallel to the bracket guide; and a first strap arranged to extend around a portion of the wheel and between the first locking pin and the second locking pin, the first strap extending between the wheel and the first wheel brake and between the wheel and the second wheel brake, the first and second wheel brakes clamping down and holding the strap statically against the wheel preventing wheel rotation in the locked mode, and the first and second wheel brakes being positioned away from the wheel permitting the strap to move freely around the wheel and the wheel to rotate in the unlocked mode.

9. The system of claim 8, further comprising a second strap supported by a pair of suspension pins, the pair of suspension pins disposed above the first and second wheel brakes, respectively, and connected between the first jaw plate and the third jaw plate and between the second jaw plate and the fourth jaw plate, respectively.

10. The system of claim 9, further comprising a swivel point connector removably attached to the second strap, the swivel point connector configured to affix the device to another object, and to allow the device to swivel.

11. The system of claim 8, wherein the first wheel bracket arm comprises first and second fins that fan out in opposite directions from the first end of the first wheel bracket arm, the second wheel bracket arm has third and fourth fins that fan out in opposite directions from the first end of the second wheel bracket arm, the first, second, third and fourth fins extending in a direction substantially parallel to first and second wheel sides of the wheel, the first locking pin extending through a corresponding first locking pin channel in the first fin and the third fin, and the second locking pin extending through a corresponding second locking pin channel in the second fin and the fourth fin.

12. The system of claim 8, wherein an outer wheel edge of the wheel has alternating notches and grooves formed thereon, and an edge of the first wheel brake and an edge of the second wheel brake have alternating notches and grooves formed thereon, wherein the notches of the outer wheel edge of the wheel engage with the grooves of the edge of the first wheel brake and the second wheel brake, respectively, in the locked mode.

13. The system of claim 8, wherein the first spring is compressed in the locked mode and decompressed in the unlocked mode.

14. The system of claim 8, wherein the bracket guide has a first end having a diameter greater than a diameter of a main portion of the bracket guide, and the second spring is positioned between the wheel bracket base and the first end of the bracket guide.

15. A locking rotational suspension training system comprising:

a device comprising:

a wheel;

a wheel bracket comprising a wheel bracket base, a first wheel bracket arm that extends from a first side of the wheel bracket base, and a second wheel bracket arm that extends from a second side of the wheel bracket base and is substantially parallel to the first wheel bracket arm, the wheel being disposed between the first wheel bracket arm and the second wheel bracket arm;

a first locking component that is connected to and disposed between a first side of a first end of the first wheel bracket arm and a first side of a first end of the second wheel bracket arm;

a second locking component that is connected to and disposed between a second side of the first end of the first wheel bracket arm and a second side of the first end of the second wheel bracket arm;

a first grip that is attached to the first end of the first wheel bracket arm;

a second grip that is attached to the first end of the second wheel bracket arm;

a first jaw component comprising a first end comprising a first connector and a second end having a jaw axel channel therein, the first connector being configured to engage with the first locking component to place the first jaw component in a locked position and to disengage from the first locking component to place the first jaw component in an unlocked position;

a second jaw component comprising a first end comprising a second connector and a second end having the jaw axel channel therein, the second connector being configured to engage with the second locking component to place the second jaw component in a locked position and to disengage from the second locking component to place the second jaw component in an unlocked position;

a first wheel brake that is connected to the first jaw component;

a second wheel brake that is connected to the second jaw component;

a jaw bracket comprising a jaw bracket base, a first jaw bracket arm that extends from a first side of the jaw bracket base, and a second jaw bracket arm that extends from a second side of the jaw bracket base and is substantially parallel to the first jaw bracket arm, a first side of a first end of the first jaw component and a first side of a first end of the second jaw component being disposed between the first wheel bracket arm and the first jaw bracket arm, and a second side of a first end of the first jaw component and a second side of a first end of the second jaw component being disposed between the second wheel bracket arm and the second jaw bracket arm;

a master bracket comprising a master bracket base, a first master bracket arm that extends from a first side of the master bracket base, and a second master bracket arm that extends from a second side of the master bracket base, the jaw bracket being disposed between the first master bracket arm and the second master bracket arm;

a jaw axel that extends through a corresponding jaw axel channel in each of the first master bracket arm, the first jaw bracket arm, the first side of the first end of the first jaw component, the first side of the first end of the second jaw component, the first wheel bracket arm, the second wheel bracket arm, the second side of the first end of the second jaw component, the second side of the first end of the first jaw component, the second jaw bracket arm, and the master bracket arm;

a wheel axel that extends through a corresponding wheel axel channel in each of the first master bracket arm, the first jaw bracket arm, the first wheel bracket arm, the wheel, the second wheel bracket arm, the second jaw bracket arm, and the second master bracket arm;

a bracket guide that extends through a corresponding bracket guide channel in each of the master bracket base, the jaw bracket base, and the wheel bracket base;

a first spring surrounding the bracket guide between the master bracket and the jaw bracket; and a second spring surrounding the bracket guide between the wheel bracket and a first end of the bracket guide;

the first and second grips being configured to transition the device from a locked mode to an unlocked mode by pulling on the first and second grips in a direction substantially parallel to the bracket guide, the wheel axel channel in the jaw bracket having a length in the direction substantially parallel to the bracket guide larger than a diameter of the wheel axel allowing the wheel axel to slide therein in the direction substantially parallel to the bracket guide, and the jaw axel channel in the master bracket having a length in the direction substantially parallel to the bracket guide larger than a diameter of the jaw axel allowing the jaw axel to slide therein in the direction substantially parallel to the bracket guide; and a first strap arranged to extend around a portion of the wheel and between the first locking pin and the second locking pin, the first strap extending between the wheel and the first wheel brake and between the wheel and the second wheel brake, the first and second wheel brakes clamping down and holding the strap statically against the wheel preventing wheel rotation in the locked mode, and the first and second wheel brakes being positioned away from the wheel permitting the strap to move freely around the wheel and the wheel to rotate in the unlocked mode.

16. The system of claim 15, further comprising a second strap supported by a pair of suspension pins, the pair of suspension pins being disposed above the first and second wheel brakes, respectively, and connected to the first jaw component and the second jaw component, respectively.

17. The system of claim 16, further comprising a swivel point connector removably attached to the second strap, the swivel point connector configured to affix the device to another object, and to allow the device to swivel.

18. The system of claim 15, wherein an outer wheel edge of the wheel has alternating notches and grooves formed thereon, and an edge of the first wheel brake and an edge of the second wheel brake have alternating notches and grooves formed thereon, wherein the notches of the outer wheel edge of the wheel engage with the grooves of the edge of the first wheel brake and the second wheel brake, respectively, in the locked mode.

19. The system of claim 15, wherein the first spring is compressed in the locked mode and decompressed in the unlocked mode.

20. The system of claim 15, wherein the bracket guide has a first end having a diameter greater than a diameter of a main portion of the bracket guide, and the second spring is positioned between the wheel bracket base and the first end of the bracket guide.

* * * * *